US008425651B2

(12) United States Patent
Xu et al.

(10) Patent No.: US 8,425,651 B2
(45) Date of Patent: Apr. 23, 2013

(54) NANOMATRIX METAL COMPOSITE

(75) Inventors: Zhiyue Xu, Cypress, TX (US); Soma Chakraborty, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 12/847,594

(22) Filed: Jul. 30, 2010

(65) Prior Publication Data

US 2012/0024109 A1 Feb. 2, 2012

(51) Int. Cl.
*B22F 9/02* (2006.01)

(52) U.S. Cl.
USPC ..... 75/245; 75/249; 977/742

(58) Field of Classification Search ..... 75/249, 75/245; 977/742
See application file for complete search history.

(56) References Cited

U.S. PATENT DOCUMENTS

| | | | |
|---|---|---|---|
| 2,238,895 | A | 4/1941 | Gage |
| 2,261,292 | A | 11/1941 | Salnikov |
| 2,983,634 | A | 5/1961 | Budininkas et al. |
| 3,106,959 | A | 10/1963 | Huitt et al. |
| 3,152,009 | A | 10/1964 | DeLong |
| 3,326,291 | A | 6/1967 | Zandmer et al. |
| 3,390,724 | A | 7/1968 | Caldwell |
| 3,465,181 | A | 9/1969 | Colby et al. |
| 3,513,230 | A | 5/1970 | Rhees et al. |
| 3,637,446 | A | 1/1972 | Elliott et al. |
| 3,645,331 | A | 2/1972 | Maurer et al. |
| 3,775,823 | A | 12/1973 | Adolph et al. |
| 3,894,850 | A | 7/1975 | Kovalchuk et al. |
| 4,010,583 | A | 3/1977 | Highberg |
| 4,039,717 | A | 8/1977 | Titus |
| 4,157,732 | A | 6/1979 | Fonner |
| 4,248,307 | A | 2/1981 | Silberman et al. |
| 4,372,384 | A | 2/1983 | Kinney |

(Continued)

FOREIGN PATENT DOCUMENTS

| | | |
|---|---|---|
| EP | 1798301 A1 | 8/2006 |
| GB | 912956 | 12/1962 |

(Continued)

OTHER PUBLICATIONS

Abdoulaye Seyni, Nadine Le Bolay, Sonia Molina-Boisseau, "On the interest of using degradable fillers in co-ground composite materials", Powder Technology 190, (2009) pp. 176-184.

(Continued)

*Primary Examiner* — George Wyszomierski
*Assistant Examiner* — Tima M McGuthry Banks
(74) *Attorney, Agent, or Firm* — Cantor Colburn LLP

(57) ABSTRACT

A powder metal composite is disclosed. The powder metal composite includes a substantially-continuous, cellular nanomatrix comprising a nanomatrix material. The composite also includes a plurality of dispersed first particles each comprising a first particle core material that comprises Mg, Al, Zn or Mn, or a combination thereof, dispersed in the nanomatrix; a plurality of dispersed second particles intermixed with the dispersed first particles, each comprising a second particle core material that comprises a carbon nanoparticle; and a solid-state bond layer extending throughout the nanomatrix between the dispersed first and second particles. The nanomatrix powder metal composites are uniquely lightweight, high-strength materials that also provide uniquely selectable and controllable corrosion properties, including very rapid corrosion rates, useful for making a wide variety of degradable or disposable articles, including various downhole tools and components.

27 Claims, 6 Drawing Sheets

U.S. PATENT DOCUMENTS

| | | | |
|---|---|---|---|
| 4,373,584 | A | 2/1983 | Silberman et al. |
| 4,374,543 | A | 2/1983 | Richardson |
| 4,384,616 | A | 5/1983 | Dellinger |
| 4,399,871 | A | 8/1983 | Adkins et al. |
| 4,422,508 | A | 12/1983 | Rutledge, Jr. et al. |
| 4,452,311 | A | 6/1984 | Speegle et al. |
| 4,498,543 | A | 2/1985 | Pye et al. |
| 4,499,048 | A | 2/1985 | Hanejko |
| 4,499,049 | A | 2/1985 | Hanejko |
| 4,534,414 | A | 8/1985 | Pringle |
| 4,539,175 | A | 9/1985 | Lichti et al. |
| 4,640,354 | A | 2/1987 | Boisson |
| 4,664,962 | A | 5/1987 | DesMarais, Jr. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |
| 4,709,761 | A | 12/1987 | Setterberg, Jr. |
| 4,714,116 | A | 12/1987 | Brunner |
| 4,716,964 | A | 1/1988 | Erbstoesser et al. |
| 4,721,159 | A | 1/1988 | Ohkochi et al. |
| 4,738,599 | A | 4/1988 | Shilling |
| 4,741,973 | A | 5/1988 | Condit et al. |
| 4,768,588 | A | 9/1988 | Kupsa |
| 4,784,226 | A | 11/1988 | Wyatt |
| 4,805,699 | A | 2/1989 | Halbardier |
| 4,817,725 | A | 4/1989 | Jenkins |
| 4,834,184 | A | 5/1989 | Streich et al. |
| H635 | H | 6/1989 | Johnson et al. |
| 4,850,432 | A | 7/1989 | Porter et al. |
| 4,853,056 | A | 8/1989 | Hoffman |
| 4,869,324 | A | 9/1989 | Holder |
| 4,869,325 | A | 9/1989 | Halbardier |
| 4,889,187 | A | 12/1989 | Terrell et al. |
| 4,890,675 | A | 1/1990 | Dew |
| 4,909,320 | A | 3/1990 | Hebert et al. |
| 4,929,415 | A | 5/1990 | Okazaki |
| 4,932,474 | A | 6/1990 | Schroeder, Jr. et al. |
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Mueller et al. |
| 5,006,044 | A | 4/1991 | Walker, Sr. et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,063,775 | A | 11/1991 | Walker, Sr. et al. |
| 5,074,361 | A | 12/1991 | Brisco et al. |
| 5,084,088 | A | 1/1992 | Okazaki |
| 5,090,480 | A | 2/1992 | Pittard et al. |
| 5,095,988 | A | 3/1992 | Bode |
| 5,103,911 | A | 4/1992 | Heijnen |
| 5,117,915 | A | 6/1992 | Mueller et al. |
| 5,161,614 | A | 11/1992 | Wu et al. |
| 5,178,216 | A | 1/1993 | Giroux et al. |
| 5,181,571 | A | 1/1993 | Mueller et al. |
| 5,188,182 | A | 2/1993 | Echols, III et al. |
| 5,188,183 | A | 2/1993 | Hopmann et al. |
| 5,222,867 | A | 6/1993 | Walker, Sr. et al. |
| 5,226,483 | A | 7/1993 | Williamson, Jr. |
| 5,228,518 | A | 7/1993 | Wilson et al. |
| 5,234,055 | A | 8/1993 | Cornette |
| 5,252,365 | A | 10/1993 | White |
| 5,253,714 | A | 10/1993 | Davis et al. |
| 5,271,468 | A | 12/1993 | Streich et al. |
| 5,282,509 | A | 2/1994 | Schurr, III |
| 5,292,478 | A | 3/1994 | Scorey |
| 5,293,940 | A | 3/1994 | Hromas et al. |
| 5,309,874 | A | 5/1994 | Willermet et al. |
| 5,310,000 | A | 5/1994 | Arterbury et al. |
| 5,380,473 | A | 1/1995 | Bogue et al. |
| 5,392,860 | A | 2/1995 | Ross |
| 5,394,941 | A | 3/1995 | Venditto et al. |
| 5,398,754 | A | 3/1995 | Dinhoble |
| 5,407,011 | A | 4/1995 | Layton |
| 5,411,082 | A | 5/1995 | Kennedy |
| 5,417,285 | A | 5/1995 | Van Buskirk et al. |
| 5,425,424 | A | 6/1995 | Reinhardt et al. |
| 5,427,177 | A | 6/1995 | Jordan, Jr. et al. |
| 5,435,392 | A | 7/1995 | Kennedy |
| 5,439,051 | A | 8/1995 | Kennedy et al. |
| 5,454,430 | A | 10/1995 | Kennedy et al. |
| 5,456,317 | A | 10/1995 | Hood, III et al. |
| 5,456,327 | A | 10/1995 | Denton et al. |
| 5,464,062 | A | 11/1995 | Blizzard, Jr. |
| 5,472,048 | A | 12/1995 | Kennedy et al. |
| 5,474,131 | A | 12/1995 | Jordan, Jr. et al. |
| 5,477,923 | A | 12/1995 | Jordan, Jr. et al. |
| 5,479,986 | A | 1/1996 | Gano et al. |
| 5,526,880 | A | 6/1996 | Jordan, Jr. et al. |
| 5,526,881 | A | 6/1996 | Martin et al. |
| 5,529,746 | A | 6/1996 | Knoss et al. |
| 5,533,573 | A | 7/1996 | Jordan, Jr. et al. |
| 5,536,485 | A | 7/1996 | Kume et al. |
| 5,558,153 | A | 9/1996 | Holcombe et al. |
| 5,607,017 | A | 3/1997 | Owens et al. |
| 5,623,993 | A | 4/1997 | Van Buskirk et al. |
| 5,623,994 | A | 4/1997 | Robinson |
| 5,636,691 | A | 6/1997 | Hendrickson et al. |
| 5,641,023 | A | 6/1997 | Ross et al. |
| 5,647,444 | A | 7/1997 | Williams |
| 5,677,372 | A | 10/1997 | Yamamoto et al. |
| 5,707,214 | A | 1/1998 | Schmidt |
| 5,709,269 | A | 1/1998 | Head |
| 5,720,344 | A | 2/1998 | Newman |
| 5,765,639 | A | 6/1998 | Muth |
| 5,772,735 | A | 6/1998 | Sehgal et al. |
| 5,782,305 | A | 7/1998 | Hicks |
| 5,797,454 | A | 8/1998 | Hipp |
| 5,826,652 | A | 10/1998 | Tapp |
| 5,826,661 | A | 10/1998 | Parker et al. |
| 5,829,520 | A | 11/1998 | Johnson |
| 5,836,396 | A | 11/1998 | Norman |
| 5,857,521 | A | 1/1999 | Ross et al. |
| 5,881,816 | A | 3/1999 | Wright |
| 5,934,372 | A | 8/1999 | Muth |
| 5,941,309 | A | 8/1999 | Appleton |
| 5,960,881 | A | 10/1999 | Allamon et al. |
| 5,985,466 | A | 11/1999 | Atarashi et al. |
| 5,990,051 | A | 11/1999 | Ischy et al. |
| 5,992,452 | A | 11/1999 | Nelson, II |
| 5,992,520 | A | 11/1999 | Schultz et al. |
| 6,007,314 | A | 12/1999 | Nelson, II |
| 6,024,915 | A | 2/2000 | Kume et al. |
| 6,047,773 | A | 4/2000 | Zeltmann et al. |
| 6,050,340 | A | 4/2000 | Scott |
| 6,069,313 | A | 5/2000 | Kay |
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,142,237 | A | 11/2000 | Christmas et al. |
| 6,161,622 | A | 12/2000 | Robb et al. |
| 6,167,970 | B1 | 1/2001 | Stout et al. |
| 6,173,779 | B1 | 1/2001 | Smith |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,350 | B1 | 4/2001 | Brothers et al. |
| 6,228,904 | B1 | 5/2001 | Yadav et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,250,392 | B1 | 6/2001 | Muth |
| 6,261,432 | B1 | 7/2001 | Huber et al. |
| 6,273,187 | B1 | 8/2001 | Voisin, Jr. et al. |

6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,379 B2 3/2002 Miszewski et al.
6,371,206 B1 4/2002 Mills
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,108,080 B2 9/2006 Tessari et al.
7,111,682 B2 9/2006 Blaisdell
7,150,326 B2 12/2006 Bishop et al.
7,163,066 B2 1/2007 Lehr
7,168,494 B2 1/2007 Starr et al.
7,174,963 B2 2/2007 Bertelsen
7,182,135 B2 2/2007 Szarka
7,210,527 B2 5/2007 Walker et al.
7,210,533 B2 5/2007 Starr et al.
7,234,530 B2 6/2007 Gass
7,250,188 B2 7/2007 Dodelet et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,350,582 B2 4/2008 McKeachnie et al.
7,353,879 B2 4/2008 Todd et al.
7,360,593 B2 4/2008 Constien
7,360,597 B2 4/2008 Blaisdell
7,363,970 B2 4/2008 Corre et al.
7,387,165 B2 6/2008 Lopez de Cardenas et al.
7,401,648 B2 7/2008 Richard
7,416,029 B2 8/2008 Telfer et al.
7,426,964 B2 9/2008 Lynde et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,552,777 B2 6/2009 Murray et al.
7,552,779 B2 6/2009 Murray
7,559,357 B2 7/2009 Clem
7,575,062 B2 8/2009 East, Jr.
7,579,087 B2 8/2009 Maloney et al.
7,591,318 B2 9/2009 Tilghman
7,600,572 B2 10/2009 Slup et al.
7,604,049 B2 10/2009 Vaidya et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,757,773 B2 7/2010 Rytlewski
7,762,342 B2 7/2010 Richard et al.
7,770,652 B2 8/2010 Barnett
7,775,284 B2 8/2010 Richards et al.
7,775,286 B2 8/2010 Duphorne
7,784,543 B2 8/2010 Johnson
7,798,225 B2 9/2010 Giroux et al.

7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,913,765 B2 3/2011 Crow et al.
7,931,093 B2 4/2011 Foster et al.
7,938,191 B2 5/2011 Vaidya
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,163,060 B2 * 4/2012 Imanishi et al. ..... 75/229
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0104616 A1 8/2002 De et al.
2002/0136904 A1 9/2002 Glass et al.
2002/0162661 A1 11/2002 Krauss et al.
2003/0037925 A1 2/2003 Walker et al.
2003/0075326 A1 4/2003 Ebinger
2003/0111728 A1 6/2003 Thai et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1 1/2004 Lin
2004/0020832 A1 2/2004 Richards et al.
2004/0045723 A1 3/2004 Slup et al.
2004/0089449 A1 5/2004 Walton et al.
2004/0159428 A1 8/2004 Hammond et al.
2004/0182583 A1 9/2004 Doane et al.
2004/0231845 A1 11/2004 Cooke, Jr.
2004/0256109 A1 12/2004 Johnson
2004/0256157 A1 12/2004 Tessari et al.
2005/0034876 A1 2/2005 Doane et al.
2005/0051329 A1 3/2005 Blaisdell
2005/0102255 A1 5/2005 Bultman
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0205264 A1 9/2005 Starr et al.
2005/0205265 A1 9/2005 Todd et al.
2005/0205266 A1 9/2005 Todd et al.
2005/0241824 A1 11/2005 Burris, II et al.
2005/0241825 A1 11/2005 Burris, II et al.
2005/0257936 A1 11/2005 Lehr
2006/0012087 A1 1/2006 Matsuda et al.
2006/0045787 A1 3/2006 Jandeska, Jr. et al.
2006/0057479 A1 3/2006 Niimi et al.
2006/0081378 A1 4/2006 Howard et al.
2006/0102871 A1 5/2006 Wang et al.
2006/0108126 A1 5/2006 Horn et al.
2006/0110615 A1 5/2006 Karim et al.
2006/0116696 A1 6/2006 Odermatt et al.
2006/0124310 A1 6/2006 Lopez de Cardenas
2006/0131011 A1 6/2006 Lynde et al.
2006/0131031 A1 6/2006 McKeachnie et al.
2006/0134312 A1 6/2006 Rytlewski et al.
2006/0144515 A1 7/2006 Tada et al.
2006/0151178 A1 7/2006 Howard et al.
2006/0162927 A1 7/2006 Walker et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044958 A1 3/2007 Rytlewski et al.
2007/0044966 A1 3/2007 Davies et al.
2007/0051521 A1 3/2007 Fike et al.
2007/0054101 A1 3/2007 Sigalas et al.
2007/0057415 A1 3/2007 Katagiri et al.
2007/0062644 A1 3/2007 Nakamura et al.
2007/0074873 A1 4/2007 McKeachnie et al.
2007/0107908 A1 5/2007 Vaidya et al.
2007/0108060 A1 5/2007 Park
2007/0119600 A1 5/2007 Slup et al.
2007/0131912 A1 6/2007 Simone et al.
2007/0151009 A1 7/2007 Conrad, III et al.
2007/0151769 A1 7/2007 Slutz et al.
2007/0169935 A1 7/2007 Akbar et al.
2007/0181224 A1 8/2007 Marya et al.
2007/0185655 A1 8/2007 Le Bemadjiel
2007/0187095 A1 8/2007 Walker et al.
2007/0221373 A1 9/2007 Murray
2007/0221384 A1 9/2007 Murray
2007/0259994 A1 11/2007 Tour et al.
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0299510 A1 12/2007 Venkatraman et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0078553 A1 4/2008 George
2008/0081866 A1 4/2008 Gong et al.
2008/0099209 A1 5/2008 Loretz et al.
2008/0105438 A1 5/2008 Jordan et al.
2008/0115932 A1 5/2008 Cooke
2008/0121436 A1 5/2008 Slay et al.
2008/0127475 A1 6/2008 Griffo
2008/0149325 A1 6/2008 Crawford
2008/0149345 A1 6/2008 Bicerano
2008/0149351 A1 6/2008 Marya et al.
2008/0169105 A1 7/2008 Williamson et al.
2008/0179104 A1 * 7/2008 Zhang et al. ..... 175/374
2008/0202764 A1 8/2008 Clayton et al.
2008/0223586 A1 9/2008 Barnett
2008/0223587 A1 9/2008 Cherewyk
2008/0236829 A1 10/2008 Lynde
2008/0248205 A1 10/2008 Blanchet et al.
2008/0277109 A1 11/2008 Vaidya
2008/0277980 A1 11/2008 Koda et al.
2008/0296024 A1 12/2008 Huang et al.
2008/0314581 A1 12/2008 Brown
2008/0314588 A1 12/2008 Langlais et al.

| | | | | |
|---|---|---|---|---|
| 2009/0038858 | A1 | 2/2009 | Griffo et al. | |
| 2009/0044946 | A1 | 2/2009 | Schasteen et al. | |
| 2009/0044949 | A1 | 2/2009 | King et al. | |
| 2009/0084556 | A1 | 4/2009 | Richards et al. | |
| 2009/0084600 | A1 | 4/2009 | Severance | |
| 2009/0107684 | A1 | 4/2009 | Cooke, Jr. | |
| 2009/0145666 | A1 | 6/2009 | Radford et al. | |
| 2009/0152009 | A1 | 6/2009 | Slay et al. | |
| 2009/0159289 | A1 | 6/2009 | Avant et al. | |
| 2009/0178808 | A1 | 7/2009 | Williamson et al. | |
| 2009/0194273 | A1 | 8/2009 | Surjaatmadja et al. | |
| 2009/0205841 | A1 | 8/2009 | Kluge et al. | |
| 2009/0226340 | A1 | 9/2009 | Marya | |
| 2009/0242202 | A1 | 10/2009 | Rispler et al. | |
| 2009/0242208 | A1 | 10/2009 | Bolding | |
| 2009/0242214 | A1 | 10/2009 | Foster et al. | |
| 2009/0255667 | A1 | 10/2009 | Clem et al. | |
| 2009/0255686 | A1 | 10/2009 | Richard et al. | |
| 2009/0260817 | A1 | 10/2009 | Gambier et al. | |
| 2009/0272544 | A1 | 11/2009 | Giroux et al. | |
| 2009/0283270 | A1 | 11/2009 | Langeslag | |
| 2009/0301730 | A1 | 12/2009 | Gweily | |
| 2009/0308588 | A1 | 12/2009 | Howell et al. | |
| 2009/0317556 | A1 | 12/2009 | Macary | |
| 2010/0003536 | A1* | 1/2010 | Smith et al. | 428/608 |
| 2010/0015002 | A1 | 1/2010 | Barrera et al. | |
| 2010/0025255 | A1 | 2/2010 | Su et al. | |
| 2010/0032151 | A1 | 2/2010 | Duphorne | |
| 2010/0044041 | A1 | 2/2010 | Smith et al. | |
| 2010/0051278 | A1 | 3/2010 | Mytopher et al. | |
| 2010/0089583 | A1 | 4/2010 | Xu et al. | |
| 2010/0089587 | A1 | 4/2010 | Stout | |
| 2010/0101803 | A1 | 4/2010 | Clayton et al. | |
| 2010/0139930 | A1 | 6/2010 | Patel et al. | |
| 2010/0200230 | A1 | 8/2010 | East, Jr. et al. | |
| 2010/0236793 | A1 | 9/2010 | Bjorgum | |
| 2010/0236794 | A1 | 9/2010 | Duan et al. | |
| 2010/0243254 | A1 | 9/2010 | Murphy et al. | |
| 2010/0252273 | A1 | 10/2010 | Duphorne | |
| 2010/0252280 | A1 | 10/2010 | Swor et al. | |
| 2010/0270031 | A1 | 10/2010 | Patel | |
| 2010/0294510 | A1 | 11/2010 | Holmes | |
| 2011/0005773 | A1 | 1/2011 | Dusterhoft et al. | |
| 2011/0036592 | A1 | 2/2011 | Fay | |
| 2011/0048743 | A1 | 3/2011 | Stafford et al. | |
| 2011/0056692 | A1 | 3/2011 | Lopez de Cardenas et al. | |
| 2011/0067872 | A1 | 3/2011 | Agrawal | |
| 2011/0067889 | A1 | 3/2011 | Marya et al. | |
| 2011/0067890 | A1 | 3/2011 | Themig | |
| 2011/0100643 | A1 | 5/2011 | Themig et al. | |
| 2011/0127044 | A1 | 6/2011 | Radford et al. | |
| 2011/0132143 | A1* | 6/2011 | Xu et al. | 75/232 |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135805 | A1 | 6/2011 | Doucet et al. | |
| 2011/0135953 | A1 | 6/2011 | Xu et al. | |
| 2011/0136707 | A1 | 6/2011 | Xu et al. | |
| 2011/0139465 | A1 | 6/2011 | Tibbles et al. | |
| 2011/0147014 | A1 | 6/2011 | Chen et al. | |
| 2011/0186306 | A1 | 8/2011 | Marya et al. | |
| 2011/0247833 | A1 | 10/2011 | Todd et al. | |
| 2011/0253387 | A1 | 10/2011 | Ervin | |
| 2011/0259610 | A1 | 10/2011 | Shkurti et al. | |
| 2011/0277987 | A1 | 11/2011 | Frazier | |
| 2011/0277989 | A1 | 11/2011 | Frazier | |
| 2011/0284232 | A1 | 11/2011 | Huang | |
| 2011/0284243 | A1 | 11/2011 | Frazier | |
| 2012/0103135 | A1* | 5/2012 | Xu et al. | 75/233 |
| 2012/0107590 | A1* | 5/2012 | Xu et al. | 428/220 |

FOREIGN PATENT DOCUMENTS

| | | | |
|---|---|---|---|
| JP | 61067770 | | 4/1986 |
| JP | 2000185725 | A1 | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| WO | 2008/057045 | A1 | 5/2008 |
| WO | WO2008079485 | | 7/2008 |
| WO | 2009079745 | A1 | 7/2009 |

OTHER PUBLICATIONS

CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.

Constantin Vahlas, Bri Gitte Caussat, Philippe Serp, George N. Angelopoulos, "Principles and Applications of CVD Powder Technology", Materials Science and Engineering R 53 (2006) 1-72.

Guan Ling Song, Andrej Atrens "Corrosion Mechanisms of Magnesium Alloys", Advanced Engineering Materials 1999, 1, No. 1, pp. 11-33.

H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.

J. Dutta Majumdar, B. Ramesh Chandra, B.L. Mordike, R. Galun, I. Manna, "Laser Surface Engineering of a Magnesium Alloy with Al + Al2O3", Surface and Coatings Technology 179 (2004) 297-305.

J.E. Gray, B. Luan, "Protective Coatings on Magnesium and Its Alloys—a Critical Review", Journal of Alloys and Compounds 336 (2002) 88-113.

Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.

Yihua Zhu, Chunzhong Li, Qiufang Wu, "The process of coating on ultrafine particles by surface hydrolysis reaction in a fluidized bed reactor", Surface and Coatings Technology 135 (2000) 14-17.

Notification of Transmittal of the International Search Report and the Written Opinion of the International Searching Authority; PCT/US2011/047000; Korean Intellectual Property Office; Mailed Dec. 26, 2011; 8 pages.

Notification of Transmittal of the International Search Report and the Written Opinion of the International Searching Authority, or the Declaration; PCT/US2011/043036; Feb. 23, 2012.

Flow Control Systems, [online]; [retrieved on May 20, 2010]; retrieved from the Internet http://www.bakerhughes.com/products-and-services/completions-and-productions/well-completions/packers-and-flow-control/flow-control-systems.

Optisleeve Sliding Sleeve, [online]; [retrieved on Jun. 25, 2010]; retrieved from the Internet weatherford.com/weatherford/groups/.../weatherfordcorp/WFT033159.pdf.

"Sliding Sleeve", Omega Completion Technology Ltd, Sep. 29, 2009, retrieved on: www.omega-completion.com.

Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.

Notification of Transmittal of the International Search Report and the Written Opinion of the International Searching Authority, or the Declaration mailed on Feb. 23, 2012 (Dated Feb. 22, 2012) for PCT/US2011/043036.

International Search Report and Written Opinion of the International Searching Authority, or the Declaration for PCT/US2011/058105 mailed from the Korean Intellectual Property Office on May 1, 2012.

International Search Report and Written Opinion of the International Searching Authority for International Application No. PCT/US2011/058099 (filed on Oct. 27, 2011), mailed on May 11, 2012.

Baker Hughes Tools. "Baker Oil Tools Introduces Revolutionary Sand Control Completion Technology," May 2, 2005.

E. Paul Bercegeay et al., "A One-Trip Gravel Packing System"; Society of Petroleum Engineers, Offshore Technology Conference, SPE Paper No. 4771; Feb. 7-8, 1974.

Bybee, Karen. "One-Trip Completion System Eliminates Perforations," Completions Today, Sep. 2007, pp. 52-53.

Curtin, William and Brian Sheldon. "CNT-reinforced ceramics and metals," Materials Today, 2004, vol. 7, 44-49.

Galanty et al. "Consolidation of metal powders during the extrusion process," Journal of Materials Processing Technology (2002), pp. 491-496.
Hjortstam et al. "Can we achieve ultra-low resistivity in carbon nanotube-based metal composites," Applied Physics A (2004), vol. 78, Issue 8, pp. 1175-1179.
Notification of Transmittal of the International Search Report and the Written Opinion of the International Searching Authority; PCT/US2010/059259; International Searching Authority KIPO; Mailed Jun. 13, 2011.
Notification of Transmittal of the International Search Report and the Written Opinion of the International Searching Authority; PCT/US2010/059265; International Searching Authority KIPO; Mailed Jun. 16, 2011.
Notification of Transmittal of the International Search Report and the Written Opinion of the International Searching Authority; PCT/US2010/059268; International Searching Authority KIPO; Mailed Jun. 17, 2011.
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Pardo, et al.; "Corrosion Behaviour of Magnesium/Aluminium Alloys in 3.5 wt% NaC1"; Corrosion Science; 50; pp. 823-834; (2008).
Notification of Transmittal of the International Search Report and Written Opinion, Mailed Jul. 8, 2011, International Appln. No. PCT/US2010/059263, Written Opinion 4 Pages, International Search Report 3 Pages.
Song, G. and S. Song. "A Possible Biodegradable Magnesium Implant Material," Advanced Engineering Materials, vol. 9, Issue 4, Apr. 2007, pp. 298-302.
Song, et al.; "Understanding Magnesium Corrosion"; Advanced Engineering Materials; 5; No. 12; pp. 837-858; (2003).
Zeng et al. "Progress and Challenge for Magnesium Alloys as Biomaterials," Advanced Engineering Materials, vol. 10, Issue 8, Aug. 2008, pp. B3-B14.
Yi Feng, Hailong Yuan, "Electroless Plating of Carbon Nanotubes with Silver" Journal fo Materials Science, 39, (2004) pp. 3241-3243.
E. Flahaut et al., "Carbon Nanotube-Metal-Oxide Nanocomposites: Microstructure, Electrical Conductivity and Mechanical Properties" Acta amter. 48 (2000) 3803-3812.
C.S. Goh, J. Wei, L C Lee, and M. Gupta, "Development of novel carbon nanotube reinforced magnesium nanocomposites using the powder metallurgy technique", Nanottechnology 17 (2006) 7-12.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Jing Sun, Lian Gao, Wei Li, "Colloidal Processing fo Carbon Nanotube/Alumina Composites" Chem. Mater. 2002, 14, 5169-5172.
Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.
Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.
Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.
Y. Zhang and Hongjie Dai, "Formation of metal nanowires on suspended single-walled carbon nanotubes" Applied Physics Letter, vol. 77, No. 19 (2000), pp. 3015-3017.
Ambat, et al.; "Electroless Nickel-Plating on AZ91D Magnesium Alloy: Effect of Substrate Microstructure and Plating Parameters"; Surface and Coatings Technology; 179; pp. 124-134; (2004).
Chang, et al.; "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Forsyth, et al.; "Exploring Corrosion Protection of Mg Via Ionic Liquid Pretreatment"; Surface & Coatings Technology; 201; pp. 4496-4504; (2007).
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
Shi et al.; "Influence of the Beta Phase on the Corrosion Performance of Anodised Coatings on Magnesium-Aluminium Alloys"; Corrosion Science; 47; pp. 2760-2777; (2005).
Song, et al.; "Corrosion Mechanisms of Magnesium Alloys"; Advanced Engineering Materials; 1(1); pp. 11-33; (1999).
Song, Guangling; "Recent Progress in Corrosion and Protection of Magnesium Alloys"; Advanced Engineering Materials; 7(7); pp. 563-586; (2005).
Song, et al.; "Influence of Microstructure on the Corrosion of Diecast AZ91D"; Corrosion Science; 41; pp. 249-273; (1999).
Song, et al.; "Corrosion Behaviour of AZ21, AZ501 and AZ91 in Sodium Chloride"; Corrosion Science; 40(10); pp. 1769-1791; (1998).
Zhang, et al; "Study on the Environmentally Friendly Anodizing of AZ91D Magnesium Alloy"; Surface and Coatings Technology: 161; pp. 36-43; (2002).
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
Patent Cooperation Treaty International Search Report and Written Opinion for International Patent Application No. PCT/US2012/034978 filed on Apr. 25, 2012, mailed on Nov. 12, 2012.
Forsythe et al. An Ionic Liquid Surface Treatment for Corrosion Protection of Magnesium Alloy AZ31. Electrochem. Solid-State Lett., vol. 9, Issue 11, pp. B52-B55. Aug. 29, 2006.
Shimuzu et al. Multi-walled carbon nanotube-reinforced magnesium alloy composites. Scripta Materialia, vol. 58, Issue 4, pp. 267-279. Feb. 2008.

* cited by examiner

NANOMATRIX METAL COMPOSITE

CROSS REFERENCE TO RELATED APPLICATIONS

This application contains subject matter related to the subject matter of the following co-pending applications: U.S. patent application Ser. Nos. 12,633,682; 12/633,686; 12/633,688; 12/633,678; 12/633,683; 12/633,662; 12/633,677; and 12/633,668 that were all filed on Dec. 8, 2009; which are assigned to the same assignee as this application, Baker Hughes Incorporated of Houston, Tex.; and which are incorporated herein by reference in their entirety.

BACKGROUND

Operators in the downhole drilling and completion industry often utilize wellbore components or tools that, due to their function, are only required to have limited service lives that are considerably less than the service life of the well. After a component or tool service function is complete, it must be removed or disposed of in order to recover the original size of the fluid pathway for use, including for example, hydrocarbon production, $CO_2$ sequestration, etc. Disposal of components or tools has conventionally been accomplished by milling or drilling the component or tool out of the borehole. Such operations are generally time consuming and expensive.

In order to eliminate the need for milling or drilling operations, the removal of components or tools by dissolution of degradable polylactic polymers using various wellbore fluids has been proposed. However, these polymers generally do not have the mechanical strength, fracture toughness and other mechanical properties necessary to perform the functions of wellbore components or tools over the operating temperature range of the wellbore, therefore, their application has been limited.

Therefore, the development of materials that can be used to form wellbore components and tools having the mechanical properties necessary to perform their intended function and then removed from the wellbore by controlled dissolution using wellbore fluids is very desirable.

SUMMARY

An exemplary embodiment of powder metal composite is disclosed. The powder composite includes a substantially-continuous, cellular nanomatrix comprising a nanomatrix material. The composite also includes a plurality of dispersed first particles each comprising a first particle core material that comprises Mg, Al, Zn or Mn, or a combination thereof, dispersed in the cellular nanomatrix. The composite also includes a plurality of dispersed second particles intermixed with the dispersed first particles, each comprising a second particle core material that comprises a carbon nanoparticle. The composite further includes a solid-state bond layer extending throughout the cellular nanomatrix between the dispersed first particles and the dispersed second particles.

BRIEF DESCRIPTION OF THE DRAWINGS

Referring now to the drawings wherein like elements are numbered alike in the several Figures.

DETAILED DESCRIPTION

Figure 1:
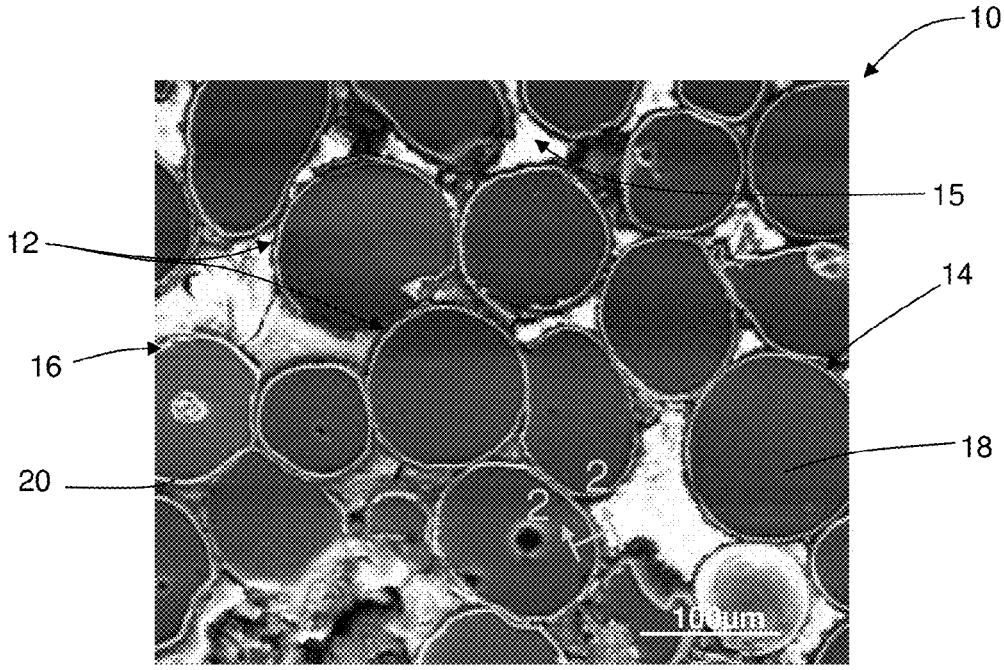
FIG. 1 is a photomicrograph of a first powder 10 as disclosed herein that has been embedded in an epoxy specimen mounting material and sectioned.

Lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder composites formed from coated powder materials that include various lightweight particle cores and core materials having various single layer and multilayer nanoscale coatings. These powder composites are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder composites also include dispersed metallized carbon nanoparticles. The carbon nanoparticles may also be coated with various single layer and multilayer nanoscale coatings, which may include the same coatings that are used to coat the metal particle cores. The metallized carbon nanoparticles act as strengthening agents within the microstructure of the powder composite. They also may be used to further reduce the density of the powder composites by substituting the carbon nanoparticles for a portion of the metal particle cores within the nanomatrix. By using the same or similar coatings materials as are used to coat the particle cores, the coatings for the carbon nanoparticles are also incorporated into the cellular nanomatrix.

These powder composites provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder composites suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder composite materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the composite, including a property change in a wellbore fluid that is in contact with the powder composite. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder composites and engineered materials formed from them, as well as methods of making them, are described further below.

Referring to FIGS. 1-7, a metallic powder that may be used to fashion precursor powder composite 100 (FIG. 13) and powder composites 200 (FIGS. 9-12) comprises a first powder 10 that includes a plurality of metallic, coated first powder particles 12 and second powder 30 that includes a plurality of second powder particles 32 that comprise carbon nanoparticles. First powder particles 12 and second powder particles 32 may be formed and intermixed to provide a powder mixture 5 (FIG. 7), including free-flowing powder, that may be poured or otherwise disposed in all manner of forms or molds (not shown) having all manner of shapes and sizes and that may be used to fashion precursor powder composites 100 (FIG. 13) and powder composites 200 (FIGS. 9-12), as described herein, that may be used as, or for use in manufacturing, various articles of manufacture, including various wellbore tools and components.

Each of the metallic, coated first powder particles 12 of first powder 10 includes a first particle core 14 and a first metallic coating layer 16 disposed on the particle core 14. The particle core 14 includes a first core material 18. The core material 18 may include any suitable material for forming the particle core 14 that provides powder particle 12 that can be sintered to form a lightweight, high-strength powder composite 200 having selectable and controllable dissolution characteristics. Suitable core materials include electrochemically active metals having a standard oxidation potential greater than or equal to that of Zn, including Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 18 may also include other metals that are less electrochemically active than Zn or non-metallic materials, or a combination thereof. Suitable non-metallic materials include ceramics, composites, glasses or carbon, or a combination thereof. Core material 18 may be selected to provide a high dissolution rate in a predetermined wellbore fluid, but may also be selected to provide a relatively low dissolution rate, including zero dissolution, where rapid dissolution of the nanomatrix material causes the particle core 14 to be rapidly undermined and liberated from the particle composite at the interface with the wellbore fluid, such that the effective rate of dissolution of particle composites made using particle cores 14 of these core materials 18 is high, even though core material 18 itself may have a low dissolution rate, including core materials that may be substantially insoluble in the wellbore fluid.

With regard to the electrochemically active metals as core materials 18, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 18 may also include other constituents, including various alloying additions, to alter one or more properties of the particle cores 14, such as by improving the strength, lowering the density or altering the dissolution characteristics of the core material 18.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 14 and core material 18, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in any suitable amount, including in an amount of about 5% or less.

Particle core 14 and core material 18 have a melting temperature ($T_P$). As used herein, $T_{P1}$ includes the lowest temperature at which incipient melting or liquation or other forms of partial melting occur within core material 18, regardless of whether core material 18 comprises a pure metal, an alloy with multiple phases having different melting temperatures or a composite of materials having different melting temperatures.

Particle cores 14 may have any suitable particle size or range of particle sizes or distribution of particle sizes. For example, the particle cores 14 may be selected to provide an average particle size that is represented by a normal or Gaussian type unimodal distribution around an average or mean, as illustrated generally in FIG. 1. In another example, particle cores 14 may be selected or mixed to provide a multimodal distribution of particle sizes, including a plurality of average particle core sizes, such as, for example, a homogeneous bimodal distribution of average particle sizes, as illustrated generally and schematically in FIG. 6. The selection of the distribution of particle core size may be used to determine, for example, the particle size and interparticle spacing 15 of the particles 12 of first powder 10. In an exemplary embodiment, the particle cores 14 may have a unimodal distribution and an average particle diameter of about 5 μm to about 300 μm, more particularly about 80 μm to about 120 μm, and even more particularly about 100 μm.

Particle cores 14 may have any suitable particle shape, including any regular or irregular geometric shape, or combination thereof. In an exemplary embodiment, particle cores 14 are substantially spheroidal electrochemically active metal particles. In another exemplary embodiment, particle cores 14 may include substantially irregularly shaped ceramic particles. In yet another exemplary embodiment, particle cores 14 may include carbon nanotube, flat graphene or spherical nanodiamond structures, or hollow glass microspheres, or combinations thereof.

Figure 2:
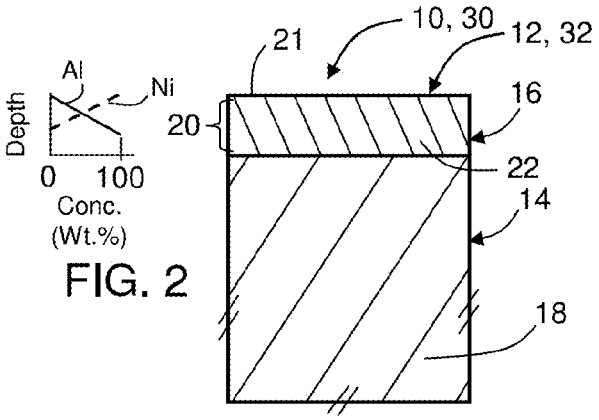
FIG. 2 is a schematic illustration of an exemplary embodiment of a powder particle 12 as it would appear in an exemplary section view represented by section 2-2 of FIG. 1.
Figure 3:
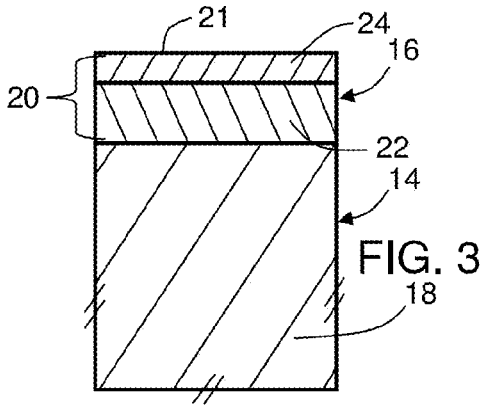
FIG. 3 is a schematic illustration of a second exemplary embodiment of a powder particle 12 as it would appear in a second exemplary section view represented by section 2-2 of FIG. 1.
Figure 4:
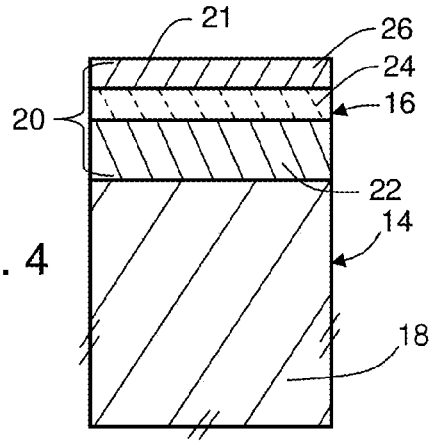
FIG. 4 is a schematic illustration of a third exemplary embodiment of a powder particle 12 as it would appear in a third exemplary section view represented by section 2-2 of FIG. 1.
Figure 5:
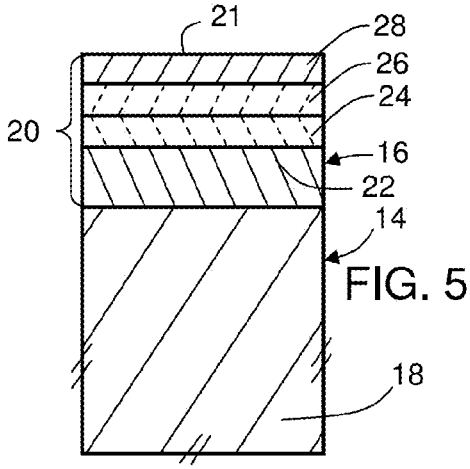
FIG. 5 is a schematic illustration of a fourth exemplary embodiment of a powder particle 12 as it would appear in a fourth exemplary section view represented by section 2-2 of FIG. 1.
Figure 6:
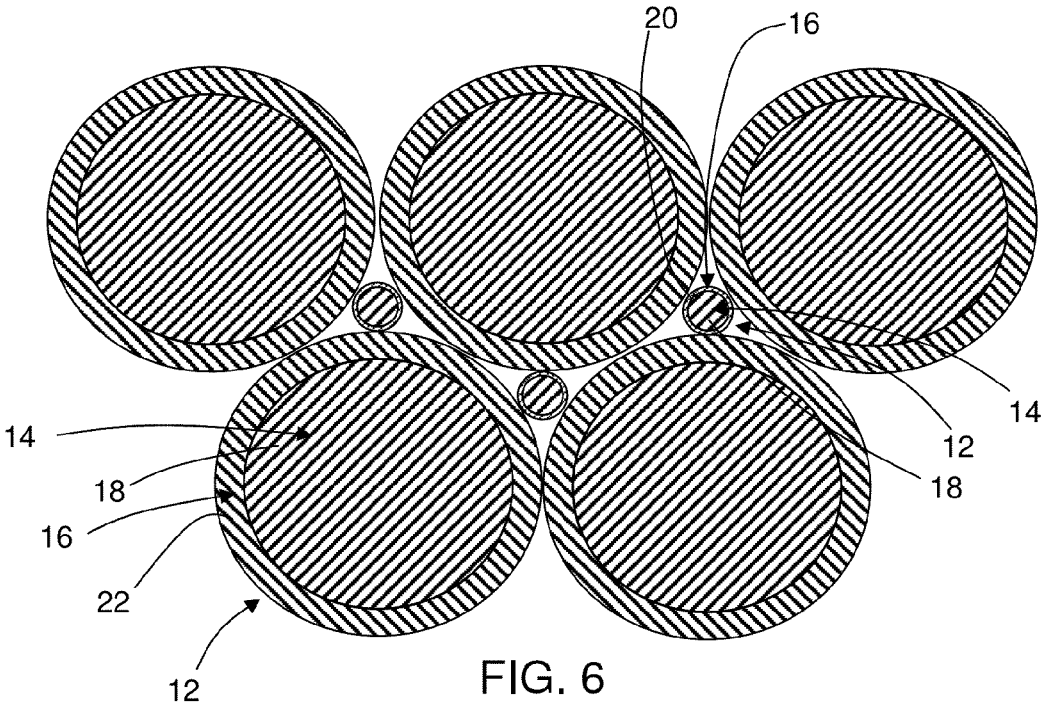
FIG. 6 is a schematic illustration of a second exemplary embodiment of a powder as disclosed herein having a multi-modal distribution of particle sizes.

Each of the metallic, coated powder particles 12 of first powder 10 also includes a metallic coating layer 16 that is disposed on particle core 14. Metallic coating layer 16 includes a metallic coating material 20. Metallic coating material 20 gives the powder particles 12 and first powder 10 its metallic nature. Metallic coating layer 16 is a nanoscale coating layer. In an exemplary embodiment, metallic coating layer 16 may have a thickness of about 25 nm to about 2500 nm. The thickness of metallic coating layer 16 may vary over the surface of particle core 14, but will preferably have a substantially uniform thickness over the surface of particle core 14. Metallic coating layer 16 may include a single layer, as illustrated in FIG. 2, or a plurality of layers as a multilayer coating structure, as illustrated in FIGS. 3-5 for up to four layers. In a single layer coating, or in each of the layers of a multilayer coating, the metallic coating layer 16 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer metallic coatings 16, each of the respective layers, or combinations of them, may be used to provide a predetermined property to the powder particles 12 or a sintered powder composite formed therefrom. For example, the predetermined property may include the bond strength of the metallurgical bond between the particle core 14 and the coating material 20; the interdiffusion characteristics between the particle core 14 and metallic coating layer 16, including any interdiffusion between the layers of a multilayer coating layer 16; the interdiffusion characteristics between the various layers of a multilayer coating layer 16; the interdiffusion characteristics between the metallic coating layer 16 of one powder particle and that of an adjacent powder particle 12; the bond strength of the metallurgical bond between the metallic coating layers of adjacent sintered powder particles 12, including the outermost layers of multilayer coating layers; and the electrochemical activity of the coating layer 16.

Metallic coating layer 16 and coating material 20 have a melting temperature ($T_{C1}$). As used herein, $T_{C1}$ includes the lowest temperature at which incipient melting or liquation or other forms of partial melting occur within coating material 20, regardless of whether coating material 20 comprises a pure metal, an alloy with multiple phases each having different melting temperatures or a composite, including a composite comprising a plurality of coating material layers having different melting temperatures.

Metallic coating material 20 may include any suitable metallic coating material 20 that provides a sinterable outer surface 21 that is configured to be sintered to an adjacent powder particle 12 that also has a metallic coating layer 16 and sinterable outer surface 21. In powder mixtures that include first powder 10 and second powder 30 that also include second or additional (coated or uncoated) particles 32, as described herein, the sinterable outer surface 21 of metallic coating layer 16 is also configured to be sintered to a sinterable outer surface 21 of second particles 32. In an exemplary embodiment, the first powder particles 12 and second powder particles 32 are sinterable at a predetermined sintering temperature ($T_S$) that is a function of the first and second core materials 18, 38 and first and second coating materials 20, 40, such that sintering of powder composite 200 is accomplished entirely in the solid state and where $T_S$ is less than $T_{P1}$, $T_{P2}$, $T_{C1}$, and $T_{C2}$. Sintering in the solid state limits particle core metallic coating layer interactions to solid state diffusion processes and metallurgical transport phenomena and limits growth of and provides control over the resultant interface between them. In contrast, for example, the introduction of liquid phase sintering would provide for rapid interdiffusion of the particle core and metallic coating layer materials and make it difficult to limit the growth of and provide control over the resultant interface between them, and thus interfere with the formation of the desirable microstructure of particle composite 200 as described herein.

In an exemplary embodiment, core material 18 will be selected to provide a core chemical composition and the coating material 20 will be selected to provide a coating chemical composition and these chemical compositions will also be selected to differ from one another. In another exemplary embodiment, the core material 18 will be selected to provide a core chemical composition and the coating material 20 will be selected to provide a coating chemical composition and these chemical compositions will also be selected to differ from one another at their interface. Differences in the chemical compositions of coating material 20 and core material 18 may be selected to provide different dissolution rates and selectable and controllable dissolution of powder composites 200 that incorporate them making them selectably and controllably dissolvable. This includes dissolution rates that differ in response to a changed condition in the wellbore, including an indirect or direct change in a wellbore fluid. In an exemplary embodiment, a powder composite 200 formed from first powder 10 having chemical compositions of core material 18 and coating material 20 that make composite 200 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

In an exemplary embodiment of a first powder 10, particle core 14 includes Mg, Al, Mn or Zn, or a combination thereof, as core material 18, and more particularly may include pure Mg and Mg alloys, and metallic coating layer 16 includes Al, Zn, Mn, Mg, Mo, W, Cu, Fe, Si, Ca, Co, Ta, Re, or Ni, or an oxide, nitride or a carbide thereof, or a combination of any of the aforementioned materials as coating material 20.

In another exemplary embodiment of first powder 10, particle core 14 includes Mg, Al, Mn or Zn, or a combination thereof, as core material 18, and more particularly may include pure Mg and Mg alloys, and metallic coating layer 16 includes a single layer of Al or Ni, or a combination thereof, as coating material 20, as illustrated in FIG. 2. Where metallic coating layer 16 includes a combination of two or more constituents, such as Al and Ni, the combination may include various graded or co-deposited structures of these materials where the amount of each constituent, and hence the composition of the layer, varies across the thickness of the layer, as also illustrated in FIG. 2.

In yet another exemplary embodiment, particle core 14 includes Mg, Al, Mn or Zn, or a combination thereof, as core material 18, and more particularly may include pure Mg and Mg alloys, and coating layer 16 includes two layers as core material 20, as illustrated in FIG. 3. The first layer 22 is disposed on the surface of particle core 14 and includes Al or Ni, or a combination thereof, as described herein. The second layer 24 is disposed on the surface of the first layer and includes Al, Zn, Mg, Mo, W, Cu, Fe, Si, Ca, Co, Ta, Re or Ni, or a combination thereof, and the first layer has a chemical composition that is different than the chemical composition of the second layer. In general, first layer 22 will be selected to provide a strong metallurgical bond to particle core 14 and to limit interdiffusion between the particle core 14 and coating layer 16, particularly first layer 22. Second layer 24 may be selected to increase the strength of the metallic coating layer 16, or to provide a strong metallurgical bond and promote sintering with the second layer 24 of adjacent powder particles 12, or both. In an exemplary embodiment, the respective layers of metallic coating layer 16 may be selected to promote the selective and controllable dissolution of the coating layer 16 in response to a change in a property of the wellbore, including the wellbore fluid, as described herein. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein. Exemplary embodiments of a two-layer metallic coating layers 16 for use on particles cores 14 comprising Mg include first/second layer combinations comprising Al/Ni and Al/W.

In still another embodiment, particle core 14 includes Mg, Al, Mn or Zn, or a combination thereof, as core material 18, and more particularly may include pure Mg and Mg alloys, and coating layer 16 includes three layers, as illustrated in FIG. 4. The first layer 22 is disposed on particle core 14 and may include Al or Ni, or a combination thereof. The second layer 24 is disposed on first layer 22 and may include Al, Zn, Mg, Mo, W, Cu, Fe, Si, Ca, Co, Ta, Re or Ni, or an oxide, nitride or a carbide thereof, or a combination of any of the aforementioned second layer materials. The third layer 26 is disposed on the second layer 24 and may include Al, Mn, Fe, Co, Ni or a combination thereof. In a three-layer configuration, the composition of adjacent layers is different, such that the first layer has a chemical composition that is different than the second layer, and the second layer has a chemical composition that is different than the third layer. In an exemplary embodiment, first layer 22 may be selected to provide a strong metallurgical bond to particle core 14 and to limit interdiffusion between the particle core 14 and coating layer 16, particularly first layer 22. Second layer 24 may be selected to increase the strength of the metallic coating layer 16, or to limit interdiffusion between particle core 14 or first layer 22 and outer or third layer 26, or to promote adhesion and a strong metallurgical bond between third layer 26 and first layer 22, or any combination of them. Third layer 26 may be selected to provide a strong metallurgical bond and promote sintering with the third layer 26 of adjacent powder particles 12. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein. An exemplary embodiment of a three-layer coating layer for use on particles cores comprising Mg include first/second/third layer combinations comprising $Al/Al_2O_3/Al$.

In still another embodiment, particle core 14 includes Mg, Al, Mn or Zn, or a combination thereof, as core material 18, and more particularly may include pure Mg and Mg alloys, and coating layer 16 includes four layers, as illustrated in FIG. 5. In the four layer configuration, the first layer 22 may include Al or Ni, or a combination thereof, as described herein. The second layer 24 may include Al, Zn, Mg, Mo, W, Cu, Fe, Si, Ca, Co, Ta, Re or Ni or an oxide, nitride, carbide thereof, or a combination of the aforementioned second layer materials. The third layer 26 may also include Al, Zn, Mg, Mo, W, Cu, Fe, Si, Ca, Co, Ta, Re or Ni, or an oxide, nitride or carbide thereof, or a combination of any of the aforementioned third layer materials. The fourth layer 28 may include Al, Mn, Fe, Co, Ni or a combination thereof. In the four layer configuration, the chemical composition of adjacent layers is different, such that the chemical composition of first layer 22 is different than the chemical composition of second layer 24, the chemical composition is of second layer 24 different than the chemical composition of third layer 26, and the chemical composition of third layer 26 is different than the chemical composition of fourth layer 28. In an exemplary embodiment, the selection of the various layers will be similar to that described for the three-layer configuration above with regard to the inner (first) and outer (fourth) layers, with the second and third layers available for providing enhanced interlayer adhesion, strength of the overall metallic coating layer 16, limited interlayer diffusion or selectable and controllable dissolution, or a combination thereof. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein.

The thickness of the various layers in multi-layer configurations may be apportioned between the various layers in any manner so long as the sum of the layer thicknesses provide a nanoscale coating layer 16, including layer thicknesses as described herein. In one embodiment, the first layer 22 and outer layer (24, 26, or 28 depending on the number of layers)

may be thicker than other layers, where present, due to the desire to provide sufficient material to promote the desired bonding of first layer 22 with the particle core 14, or the bonding of the outer layers of adjacent powder particles 12, during sintering of powder composite 200.

Figure 7:
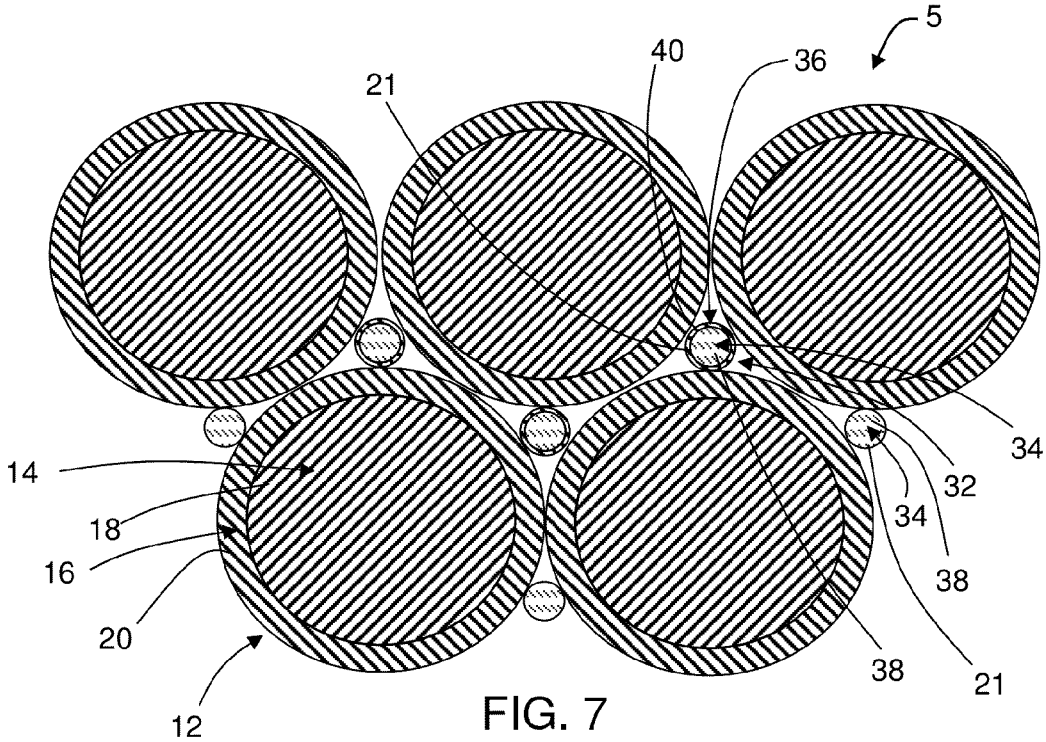
FIG. 7 is a schematic illustration of a third exemplary embodiment of a powder as disclosed herein having a multi-modal distribution of particle sizes.

First powder 10 also includes an additional or second powder 30 interspersed in the plurality of first powder particles 12, as illustrated in FIG. 7. In an exemplary embodiment, the second powder 30 includes a plurality of second powder particles 32. Second powder particles 32 comprise second particle cores 34 that include second particle core material 38. Second particle core material 38 may include various carbon nanomaterials, including various carbon nanoparticles, and more particularly nanometer-scale particulate allotropes of carbon. This may include any suitable allotropic form of carbon, including any solid particulate allotrope, and particularly including any nanoparticles comprising graphene, fullerene or nanodiamond particle structures. Suitable fullerenes may include buckeyballs, buckeyball clusters, buckeypapers or nanotubes, including single-wall nanotubes and multi-wall nanotubes. Fullerenes also include three-dimensional polymers of any of the above. Suitable fullerenes may also include metallofullerenes, or those which encompass various metals or metal ions. Buckeyballs may include any suitable ball size or diameter, including substantially spheroidal configurations having any number of carbon atoms, including $C_{60}$, $C_{70}$, $C_{76}$, $C_{84}$ and the like. Both single-wall and multi-wall nanotubes are substantially cylindrical may have any predetermined tube length or tube diameter, or combination thereof. Multi-wall nanotubes may have any predetermined number of walls. Graphene nanoparticles may be of any suitable predetermined planar size, including any predetermined tube length or predetermined outer diameter, and thus may include any predetermined number of carbon atoms. Nanodiamond may include any suitable spheroidal configuration having any predetermined spherical diameter, including a plurality of different predetermined diameters.

Second particle core 34 and second core material 38 have a melting temperature ($T_{P2}$). As used herein, $T_{P2}$ includes the lowest temperature at which incipient melting or liquation or other forms of partial melting occur within second core material 38.

Second particle cores 34 may have any suitable particle size or range of particle sizes or distribution of particle sizes. For example, the second particle cores 34 may be selected to provide an average particle size that is represented by a normal or Gaussian type unimodal distribution around an average or mean, similar to that illustrated generally for the first particle cores 14 in FIG. 1. In another example, second particle cores 34 may be selected or mixed to provide a multimodal distribution of particle sizes, including a plurality of average particle core sizes, such as, for example, a homogeneous bimodal distribution of average particle sizes, similar to that illustrated generally and schematically for the first particle cores 14 in FIG. 6.

In view of the fact that both first and second powder particles 12, 32 may have unimodal or multimodal particle size distribution, powder mixture 5 may have a unimodal or multimodal distribution of particle sizes. Further, the mixture of first and second powder particles may be homogeneous or heterogeneous.

These second powder particles 32 may be selected to change a physical, chemical, mechanical or other property of a powder particle composite 200 formed from first powder 10 and second powder 30, or a combination of such properties. In an exemplary embodiment, the property change may include an increase in the compressive strength of powder composite 200 formed from first powder 10 and second powder 30. In another exemplary embodiment, the second powder 30 may be selected to promote the selective and controllable dissolution of in particle composite 200 formed from first powder 10 and second powder 30 in response to a change in a property of the wellbore, including the wellbore fluid, as described herein. Second powder particles 32 include uncoated second particle cores 34 or may include second particle cores 34 that are coated with a metallic coating layer 36. When coated, including single layer or multilayer coatings, the coating layer 36 of second powder particles 32 may comprise the same coating material 40 as coating material 20 of powder particles 12, or the coating material 40 may be different. In exemplary embodiments, any of the exemplary single layer and multilayer metallic coating layer 16 combinations described herein may also be disposed on the second particle cores 34 as second metallic coating layers 36. The second powder particles 32 (uncoated) or particle cores 34 may include any suitable carbon nanoparticle to provide the desired benefit. In an exemplary embodiment, when coated powder particles 12 having first particle cores 14 comprising Mg, Al, Mn or Zn, or a combination thereof are employed, suitable second powder particles 32 having second particle cores 34 may include the exemplary carbon nanoparticles described herein. Since second powder particles 32 will also be configured for solid state sintering to powder particles 12 at the predetermined sintering temperature ($T_S$), particle cores 34 will have a melting temperature $T_{P2}$ and any coating layers 36 will have a second melting temperature $T_{C2}$, where $T_S$ is also less than $T_{P2}$ and $T_{C2}$. It will also be appreciated that second powder 30 is not limited to one additional powder particle 32 type (i.e., a second powder particle), but may include a plurality of second powder particles 32 (i.e., second, third, fourth, etc. types of second powder particles 32) in any number.

Uncoated second particles 32 may also include functionalized carbon nanoparticles that do not include a metallic coating layer but are functionalized with any desired chemical functionality using any suitable chemical or physical bonding of the chemical functionality. Functionalized carbon nanoparticles may be used to assist the bonding of the carbon nanoparticles into the nanomatrix material 220.

Figure 8:
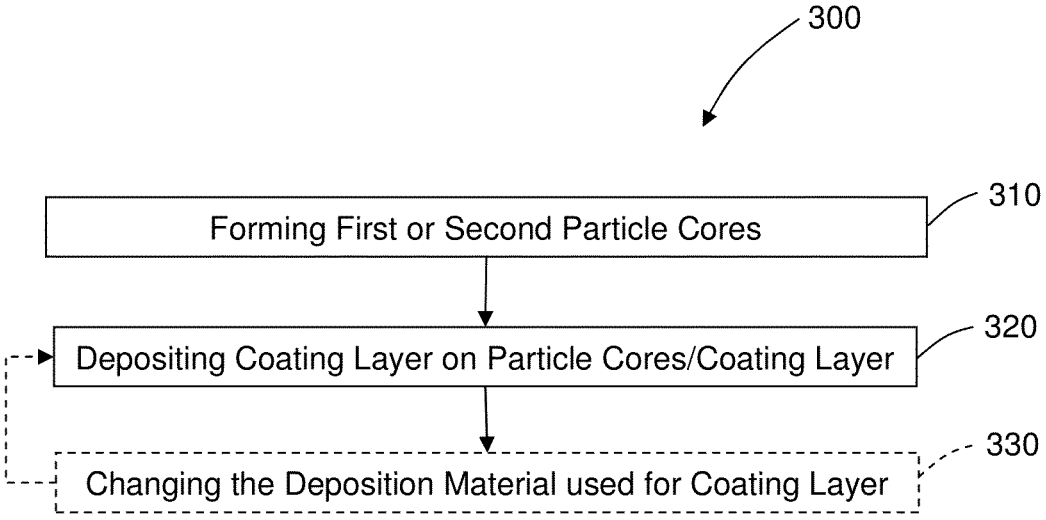
FIG. 8 is a flow chart of an exemplary embodiment of a method of making a powder as disclosed herein.

Referring to FIG. 8, an exemplary embodiment of a method 300 of making a first powder 10 or second powder 30 is disclosed. Method 300 includes forming 310 a plurality of first or second particle cores 14, 34, as described herein. Method 300 also includes depositing 320 a first or second metallic coating layer 16, 36 on each of the plurality of respective first or second particle cores 14, 34. Depositing 320 is the process by which first or second coating layer 16, 36 is disposed on each of respective first or second particle cores 14, 34 as described herein.

Forming 310 of first or second particle cores 14, 34 may be performed by any suitable method for forming a plurality of first or second particle cores 14, 34 of the desired first or second core material 18, 38, which essentially comprise methods of forming a powder of first or second core material 18, 38. Suitable metal powder forming methods for first particle core 14 may include mechanical methods; including machining, milling, impacting and other mechanical methods for forming the metal powder; chemical methods, including chemical decomposition, precipitation from a liquid or gas, solid-solid reactive synthesis, chemical vapor deposition and other chemical powder forming methods; atomization methods, including gas atomization, liquid and water atomization, centrifugal atomization, plasma atomization and other atomization methods for forming a powder; and various evaporation and condensation methods. In an exemplary embodiment, first particle cores 14 comprising Mg may be fabricated using an atomization method, such as vacuum spray forming or inert gas spray forming. In another exemplary embodiment, second particle cores 34 comprising carbon nanotubes may be formed using arc discharge, laser ablation, high pressure carbon monoxide or chemical vapor deposition.

Depositing 320 of first or second metallic coating layers 16, 36 on the plurality of respective first or second particle cores 14, 34 may be performed using any suitable deposition method, including various thin film deposition methods, such as, for example, chemical vapor deposition and physical vapor deposition methods. In an exemplary embodiment, depositing 320 of first or second metallic coating layers 16, 36 may be performed using fluidized bed chemical vapor deposition (FBCVD). Depositing 320 of the first or second metallic coating layers 16, 36 by FBCVD includes flowing a reactive fluid as a coating medium that includes the desired first or second metallic coating material 20, 40 through a bed of respective first or second particle cores 14, 34 fluidized in a reactor vessel under suitable conditions, including temperature, pressure and flow rate conditions and the like, sufficient to induce a chemical reaction of the coating medium to produce the desired first or second metallic coating material 20, 40 and induce its deposition upon the surface of first or second particle cores 14, 34 to form first or second coated powder particles 12, 32. The reactive fluid selected will depend upon the metallic coating material 20 desired, and will typically comprise an organometallic compound that includes the metallic material to be deposited, such as nickel tetracarbonyl ($Ni(CO)_4$), tungsten hexafluoride ($WF_6$), and triethyl aluminum ($C_6H_{15}Al$), that is transported in a carrier fluid, such as helium or argon gas. The reactive fluid, including carrier fluid, causes at least a portion of the plurality of first or second particle cores 14, 34 to be suspended in the fluid, thereby enabling the entire surface of the respective first or second suspended particle cores 14, 34 to be exposed to the reactive fluid, including, for example, a desired organometallic constituent, and enabling deposition of first or second metallic coating materials 20, 40 and first or second coating layers 16, 36 over the entire surfaces of first or second particle cores 14, 34 such that they each become enclosed forming first or second coated particles 12, 32 having first or second metallic coating layers 16, 36, as described herein. As also described herein, each first or second metallic coating layer 16, 36 may include a plurality of coating layers. First or second coating material 20, 40 may be deposited in multiple layers to form a multilayer first or second metallic coating layer 16, 36 by repeating the step of depositing 320 described above and changing 330 the reactive fluid to provide the desired first or second metallic coating material 20, 40 for each subsequent layer, where each subsequent layer is deposited on the outer surface of respective first or second particle cores 14, 34 that already include any previously deposited coating layer or layers that make up first or second metallic coating layer 16, 36. The first or second metallic coating materials 20, 40 of the respective layers (e.g., 22, 24, 26, 28, etc.) may be different from one another, and the differences may be provided by utilization of different reactive media that are configured to produce the desired first or second metallic coating layers 16, 36 on the first or second particle cores 14, 34 in the fluidize bed reactor.

As illustrated in FIG. 1, in an exemplary embodiment first and second particle cores 14, 34 and first and second core materials 18, 38 and first and second metallic coating layers 16, 36 and first and second coating material 20, 40 may be selected to provide first and second powder particles 12, 32 and a first and second powders 10, 30 that may be combined into a mixture as described herein and configured for compaction and sintering to provide a powder composite 200 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder composite 200 includes a substantially-continuous, cellular nanomatrix 216 of a nanomatrix material 220 having a plurality of dispersed first particles 214 and dispersed second particles 234 dispersed throughout the cellular nanomatrix 216. The substantially-continuous cellular nanomatrix 216 and nanomatrix material 220 formed of sintered first and second metallic coating layers 16, 36 is formed by the compaction and sintering of the plurality of first and second metallic coating layers 16, 36 of the plurality of first and second powder particles 12, 32. The chemical composition of nanomatrix material 220 may be different than that of first or second coating materials 20, 40 due to diffusion effects associated with the sintering as described herein. Powder metal composite 200 also includes a plurality of first and second dispersed particles 214, 234 that comprise first and second particle core materials 218, 238. First and second dispersed particle cores 214, 234 and first and second core materials 218, 238 correspond to and are formed from the plurality of first and second particle cores 14, 34 and first and second core materials 18, 38 of the plurality of first and second powder particles 12, 32 as the first and second metallic coating layers 16, 36 are sintered together to form nanomatrix 216. The chemical composition of first and second core materials 218, 238 may be different than that of first and second core material 18, 38 due to diffusion effects associated with sintering as described herein.

As used herein, the use of the term substantially-continuous cellular nanomatrix 216 does not connote the major constituent of the powder composite, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 220 within powder composite 200. As used herein, "substantially-continuous" describes the extension of the nanomatrix material throughout powder composite 200 such that it extends between and envelopes substantially all of the first and second dispersed particles 214, 234. Substantially-continuous is used to indicate that complete continuity and regular order of the nanomatrix around each of first and second dispersed particle 214, 234 is not required. For example, defects in the first or second coating layers 16, 36 over first or second particle cores 14, 34 on some of first or second powder particles 12, 32 may cause some bridging of the first or second particle cores 14, 34 during sintering of the powder composite 200, thereby causing localized discontinuities to result within the cellular nanomatrix 216, even though in the other portions of the powder composite the nanomatrix is substantially continuous and exhibits the structure described herein. As used herein, "cellular" is used to indicate that the nanomatrix defines a network of generally repeating, interconnected, compartments or cells of nanomatrix material 220 that encompass and also interconnect the first and second dispersed particles 214, 234. As used herein, "nanomatrix" is used to describe the size or scale of the matrix, particularly the thickness of the matrix between adjacent first or second dispersed particles 214, 234.

The metallic coating layers that are sintered together to form the nanomatrix are themselves nanoscale thickness coating layers. Since the nanomatrix at most locations, other than the intersection of more than two first or second dispersed particles 214, 234, generally comprises the interdiffusion and bonding of two first or second coating layers 16, 36 from adjacent first or second powder particles 12, 32 having nanoscale thicknesses, the matrix formed also has a nanoscale thickness (e.g., approximately two times the coating layer thickness as described herein) and is thus described as a nanomatrix. Further, the use of the term first or second dispersed particles 214, 234 does not connote the minor constituent of powder composite 200, but rather refers to the majority constituent or constituents, whether by weight or by volume. The use of the term dispersed particle is intended to convey the discontinuous and discrete distribution of first or second particle core materials 218, 238 within powder composite 200.

Powder composite 200 may have any desired shape or size, including that of a cylindrical billet or bar that may be machined or otherwise used to form useful articles of manufacture, including various wellbore tools and components. The pressing used to form precursor powder composite 100 and sintering and pressing processes used to form powder composite 200 and deform the first and second powder particles 12, 32, including first and second particle cores 14, 34 and first and second coating layers 16, 36, to provide the full density and desired macroscopic shape and size of powder composite 200 as well as its microstructure. The microstructure of powder composite 200 includes an equiaxed configuration of first and second dispersed particles 214, 234 that are dispersed throughout and embedded within the substantially-continuous, cellular nanomatrix 216 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 216 of sintered first or second metallic coating layers 16, 36 may be produced using constituents where thermodynamic phase equilibrium conditions would not produce an equiaxed structure. The equiaxed morphology of the first and second dispersed particles 214, 234 and cellular nanomatrix 216 of particle layers results from sintering and deformation of the first and second powder particles 12, 32 as they are compacted and interdiffuse and deform to fill the interparticle spaces 15 (FIG. 1). The sintering temperatures and pressures may be selected to ensure that the density of powder composite 200 achieves substantially full theoretical density.

Figure 9:
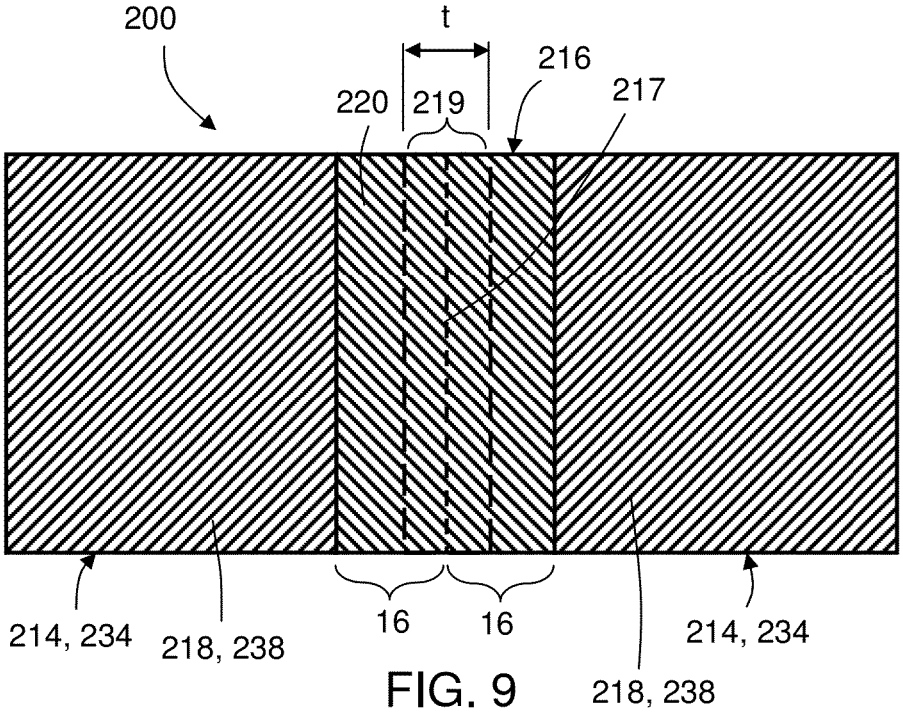
FIG. 9 is a schematic of illustration of an exemplary embodiment of adjacent first and second powder particles of a powder composite made using a powder mixture having single-layer coated powder particles.

In an exemplary embodiment as illustrated in FIG. 1, dispersed first and second particles 214, 234 are formed from first and second particle cores 14, 34 dispersed in the cellular nanomatrix 216 of sintered first and second metallic coating layers 16, 36, and the nanomatrix 216 includes a solid-state metallurgical bond 217 or bond layer 219, as illustrated schematically in FIG. 9, extending between the first or second dispersed particles 214, 234 throughout the cellular nanomatrix 216 that is formed at a sintering temperature ($T_S$), where $T_S$ is less than $T_{C1}$, $T_{C2}$ and $T_{P2}$. As indicated, solid-state metallurgical bond 217 is formed in the solid state by solid-state interdiffusion between the first or second coating layers 16, 36 of adjacent first or second powder particles 12, 32 that are compressed into touching contact during the compaction and sintering processes used to form powder composite 200, as described herein. As such, sintered coating layers 16 of cellular nanomatrix 216 include a solid-state bond layer 219 that has a thickness (t) defined by the extent of the interdiffusion of the first or second coating materials 20, 40 of the first or second coating layers 16, 36, which will in turn be defined by the nature of the coating layers 16, including whether they are single or multilayer coating layers, whether they have been selected to promote or limit such interdiffusion, and other factors, as described herein, as well as the sintering and compaction conditions, including the sintering time, temperature and pressure used to form powder composite 200.

As nanomatrix 216 is formed, including bond 217 and bond layer 219, the chemical composition or phase distribution, or both, of first or second metallic coating layers 16, 36 may change. Nanomatrix 216 also has a melting temperature ($T_M$). As used herein, $T_M$ includes the lowest temperature at which incipient melting or liquation or other forms of partial melting will occur within nanomatrix 216, regardless of whether nanomatrix material 220 comprises a pure metal, an alloy with multiple phases each having different melting temperatures or a composite, including a composite comprising a plurality of layers of various coating materials having different melting temperatures, or a combination thereof, or otherwise. As dispersed first and second particles 214, 234 and first and second particle core materials 218, 238 are formed in conjunction with nanomatrix 216, diffusion of constituents of metallic coating layers 16 into the particle cores 14 is also possible, which may result in changes in the chemical composition or phase distribution, or both, of first or second particle cores 14, 34. As a result, dispersed first and second particles 214, 234 and first and second particle core materials 218, 238 may have respective melting temperatures ($T_{DP1}$, $T_{DP2}$) that are different than $T_{P1}$, $T_{P2}$. As used herein, $T_{DP1}$, $T_{DP2}$ includes the lowest temperature at which incipient melting or liquation or other forms of partial melting will occur within dispersed first and second particles 214, 234, regardless of whether first or second particle core material 218, 238 comprise a pure metal, an alloy with multiple phases each having different melting temperatures or a composite, or otherwise. Powder composite 200 is formed at a sintering temperature ($T_S$), where $T_S$ is less than $T_{C1}$, $T_{C1}$, $T_{P1}$, $T_{P2}$, $T_M$, $T_{DP1}$ and $T_{DP2}$.

Dispersed first and second particles 214, 234 may comprise any of the materials described herein for first and second particle cores 14, 34, even though the chemical composition of dispersed first and second particles 214, 234 may be different due to diffusion effects as described herein. In an exemplary embodiment, first dispersed particles 214 are formed from first particle cores 14 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with first particle cores 14. Of these materials, those having first dispersed particles 214 comprising Mg and the nanomatrix 216 formed from the metallic coating layers 16 described herein are particularly useful. Dispersed first particles 214 and first particle core material 218 of Mg, Al, Zn or Mn, or a combination thereof, may also include a rare earth element, or a combination of rare earth elements as disclosed herein in conjunction with particle cores 14. In this exemplary embodiment, dispersed second particles 234 are formed from second particle core 34 comprising carbon nanoparticles, including buckeyballs, buckeyball clusters, buckeypaper, single-wall nanotubes and multi-wall nanotubes.

In another exemplary embodiment, dispersed particles 214 are formed from particle cores 14 comprising metals that are less electrochemically active than Zn or non-metallic materials. Suitable non-metallic materials include ceramics, glasses (e.g., hollow glass microspheres) or carbon, or a combination thereof, as described herein. In this exemplary embodiment, dispersed second particles 234 are formed from second particle core 34 comprising carbon nanoparticles, including buckeyballs, buckeyball clusters, buckeypaper, single-wall nanotubes and multi-wall nanotubes.

First and second dispersed particles 214, 234 of powder composite 200 may have any suitable particle size, including the average particle sizes described herein for first and second particle cores 14, 34.

The nature of the dispersion of first and second dispersed particles 214, 234 may be affected by the selection of the first and second powder 10, 30 or powders 10, used to make particle composite 200. First and second dispersed particles 214, 234 may have any suitable shape depending on the shape selected for first and second particle cores 14, 34 and first and second powder particles 12, 32, as well as the method used to sinter and composite first powder 10. In an exemplary embodiment, first and second powder particles 12, 32 may be spheroidal or substantially spheroidal and first and second dispersed particles 214, 234 may include an equiaxed particle configuration as described herein. In other exemplary embodiments, first powder particles 12 may be spheroidal or substantially spheroidal and second powder particles 32 may be planar, as in the case where they comprise graphene, or tubular, as in the case where they comprise nanotubes, or spheroidal, as in the case where they comprise buckeyballs, buckeyball clusters or nanodiamonds or other non-spherical forms. In these embodiments, a non-equiaxed particle structure, or microstructure, may result where the second dispersed particles 234 extend between adjacent first particles 214, or enfold or otherwise wrap around first particles 214. Many non-equiaxed microstructures may be produced using a combination of substantially spherical first powder particles 12 and non-spherical powder particles 234.

Figure 10:
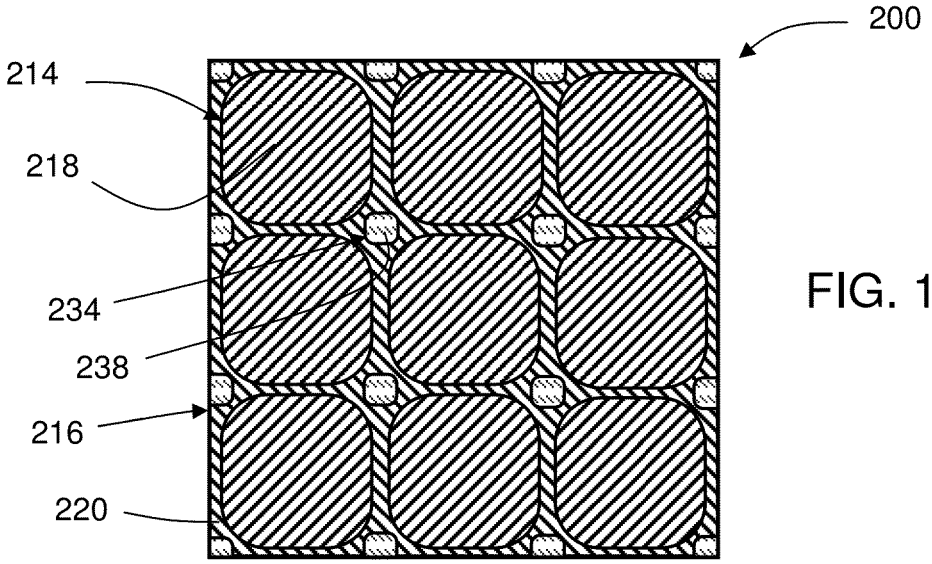
FIG. 10 is a schematic illustration of an exemplary embodiment of a powder composite as disclosed herein formed from a first powder and a second powder and having a homogenous multi-modal distribution of particle sizes.
Figure 11:
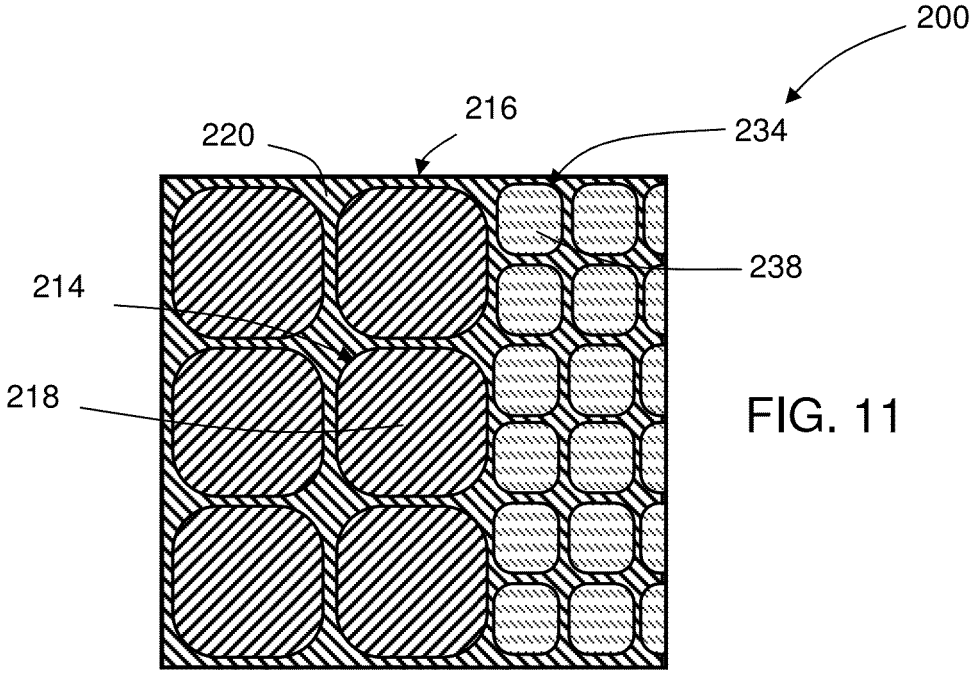
FIG. 11 is a schematic illustration of an exemplary embodiment of a powder composite as disclosed herein formed from a first powder and a second powder and having a non-homogeneous multi-modal distribution of particle sizes.

In another exemplary embodiment, the second powder particles 232 may be uncoated such that dispersed second particles 234 are embedded within nanomatrix 216. As disclosed herein, first powder 10 and second powder 30 may be mixed to form a homogeneous dispersion of dispersed first particles 214 and dispersed second particles 234, as illustrated in FIG. 10, or to form a non-homogeneous dispersion of these particles, as illustrated in FIG. 11.

Nanomatrix 216 is a substantially-continuous, cellular network of first and second metallic coating layers 16, 36 that are sintered to one another. The thickness of nanomatrix 216 will depend on the nature of the first powder 10 and second powder 30, particularly the thicknesses of the coating layers associated with these powder particles. In an exemplary embodiment, the thickness of nanomatrix 216 is substantially uniform throughout the microstructure of powder composite 200 and comprises about two times the thickness of the first and second coating layers 16, 36 of first and second powder particles 12, 32. In another exemplary embodiment, the cellular nanomatrix 216 has a substantially uniform average thickness between dispersed particles 214 of about 50 nm to about 5000 nm.

Nanomatrix 216 is formed by sintering metallic coating layers 16 of adjacent particles to one another by interdiffusion and creation of bond layer 219 as described herein. Metallic coating layers 16 may be single layer or multilayer structures, and they may be selected to promote or inhibit diffusion, or both, within the layer or between the layers of metallic coating layer 16, or between the metallic coating layer 16 and particle core 14, or between the metallic coating layer 16 and the metallic coating layer 16 of an adjacent powder particle, the extent of interdiffusion of metallic coating layers 16 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 216 and nanomatrix material 220 may be simply understood to be a combination of the constituents of first or second coating layers 16, 36 that may also include one or more constituents of first or second dispersed particles 214, 234, depending on the extent of interdiffusion, if any, that occurs between the dispersed particles 214 and the nanomatrix 216. Similarly, the chemical composition of first and second dispersed particles 214, 234 and first and second particle core materials 218, 238 may be simply understood to be a combination of the constituents of respective first and second particle cores 14, 34 that may also include one or more constituents of nanomatrix 216 and nanomatrix material 220, depending on the extent of interdiffusion, if any, that occurs between the first and second dispersed particles 214, 234 and the nanomatrix 216.

In an exemplary embodiment, the nanomatrix material 220 has a chemical composition and the first and second particle core materials 218, 238 have a chemical composition that is different from that of nanomatrix material 220, and the differences in the chemical compositions and the relative amounts, sizes, shapes and distributions of the first and second particles 12, 32 may be configured to provide a selectable and controllable dissolution rate, including a selectable transition from a very low dissolution rate to a very rapid dissolution rate, in response to a controlled change in a property or condition of the wellbore proximate the composite 200, including a property change in a wellbore fluid that is in contact with the powder composite 200, as described herein. They may also be selected to provide a selectable density or mechanical property, such as tensile strength, of powder composite 200. Nanomatrix 216 may be formed from first and second powder particles 12, 32 having single layer and multilayer first and second coating layers 16, 36. This design flexibility provides a large number of material combinations, particularly in the case of multilayer first and second coating layers 16, 36 that can be utilized to tailor the cellular nanomatrix 216 and composition of nanomatrix material 220 by controlling the interaction of the coating layer constituents, both within a given layer, as well as between first or second coating layers 16, 36 and the first or second particle cores 14, 34 with which they are associated or a coating layer of an adjacent powder particle. Several exemplary embodiments that demonstrate this flexibility are provided below.

As illustrated in FIG. 9, in an exemplary embodiment, powder composite 200 is formed from first and second powder particles 12, 32 where the coating layer 16 comprises a single layer, and the resulting nanomatrix 216 between adjacent ones of the plurality of dispersed particles 214 comprises the single metallic first or second coating layer 16, 36 of one of first or second powder particles 12, 32, a bond layer 219 and the single first or second coating layer 16, 36 of another one of the adjacent first or second powder particles 12, 32. The thickness (t) of bond layer 219 is determined by the extent of the interdiffusion between the single metallic first or second coating layers 16, 36 and may encompass the entire thickness of nanomatrix 216 or only a portion thereof. In one exemplary embodiment of powder composite 200 formed using first and second powders 10, 30 having a single metallic first and second coating layers 16, 36, powder composite 200 may include dispersed first particles 214 comprising Mg, Al, Zn or Mn, or a combination thereof, second particles 234 may include carbon nanoparticles and nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 220 of cellular nanomatrix 216, including bond layer 219, has a chemical composition and the first and second core materials 218, 238 of dispersed first and second particles 214, 234 have a chemical composition that are different than the chemical composition of nanomatrix material 216. The difference in the chemical composition of the nanomatrix material 220 and the first and second core materials 218, 238 may be used to provide selectable and controllable dissolution in response to a change in a property of a wellbore, including a wellbore fluid, as described herein. They may also be selected to provide a selectable density or mechanical property, such as tensile strength, of powder composite 200. In a further exemplary embodiment of a powder composite 200 formed from a first and second powders 10, 30 having a single coating layer configuration, dispersed first particles 214 include Mg, Al, Zn or Mn, or a combination thereof, dispersed second particles 234 include carbon nanoparticles and the cellular nanomatrix 216 includes Al or Ni, or a combination thereof.

Figure 12:
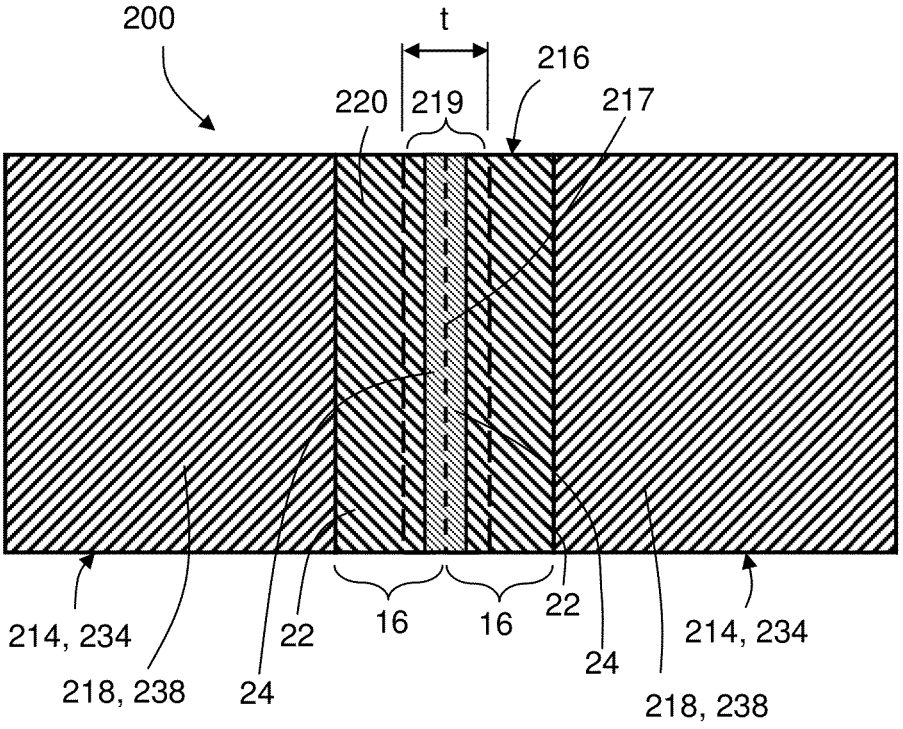
FIG. 12 is a schematic of illustration of another exemplary embodiment of adjacent first and second powder particles of a powder composite of made using a powder mixture having multilayer coated powder particles.

As illustrated in FIG. 12, in another exemplary embodiment, powder composite 200 is formed from first and second powder particles 12, 32 where the first and second coating layers 16, 36 comprise a multilayer coating having a plurality of coating layers, and the resulting nanomatrix 216 between adjacent ones of the plurality of first and second dispersed particles 214, 234 comprise the plurality of layers (t) comprising the first or second coating layers 16, 36 of one of first or second particles 12, 32, a bond layer 219, and the plurality of layers comprising the first or second coating layers 16, 36 of another one of first or second powder particles 12, 32. In FIG. 12, this is illustrated with a two-layer metallic first and second coating layers 16, 36, but it will be understood that the plurality of layers of multi-layer metallic first and second coating layers 16, 36 may include any desired number of layers. The thickness (t) of the bond layer 219 is again determined by the extent of the interdiffusion between the plurality of layers of the respective first and second coating layers 16, 36, and may encompass the entire thickness of nanomatrix 216 or only a portion thereof. In this embodiment, the plurality of layers comprising each of first and second coating layers 16, 36 may be used to control interdiffusion and formation of bond layer 219 and thickness (t).

In one exemplary embodiment of a powder composite 200 made using first and second powder particles 12, 32 with multilayer first and second coating layers 16, 36, the composite includes dispersed first particles 214 comprising Mg, Al, Zn or Mn, or a combination thereof, as described herein, dispersed second particles 234 comprising carbon nanoparticles and nanomatrix 216 comprises a cellular network of sintered two-layer first and second coating layers 16, 36, as shown in FIG. 3, comprising first layers 22 that are disposed on the dispersed first and second particles 214, 234 and second layers 24 that are disposed on the first layers 22. First layers 22 include Al or Ni, or a combination thereof, and second layers 24 include Al, Zn, Mn, Mg, Mo, W, Cu, Fe, Si, Ca, Co, Ta, Re or Ni, or a combination thereof. In these configurations, materials of dispersed particles 214 and multilayer first and second coating layers 16, 36 used to form nanomatrix 216 are selected so that the chemical compositions of adjacent materials are different (e.g. dispersed particle/first layer and first layer/second layer).

In another exemplary embodiment of a powder composite 200 made using first and second powder particles 12, 32 with multilayer first and second coating layers 16, 36, the composite includes dispersed first particles 214 comprising Mg, Al, Zn or Mn, or a combination thereof, as described herein, dispersed second particles 234 comprising carbon nanoparticles and nanomatrix 216 comprises a cellular network of sintered three-layer metallic first and second coating layers 16, 36 as shown in FIG. 4, comprising first layers 22 that are disposed on the dispersed first and second particles 214, 234, second layers 24 that are disposed on the first layers 22 and third layers 26 that are disposed on the second layers 24. First layers 22 include Al or Ni, or a combination thereof; second layers 24 include Al, Zn, Mn, Mg, Mo, W, Cu, Fe, Si, Ca, Co, Ta, Re or Ni, or an oxide, nitride or carbide thereof, or a combination of any of the aforementioned second layer materials; and the third layers include Al, Zn, Mn, Mg, Mo, W, Cu, Fe, Si, Ca, Co, Ta, Re or Ni, or a combination thereof. The selection of materials is analogous to the selection considerations described herein for powder composite 200 made using two-layer coating layer powders, but must also be extended to include the material used for the third coating layer.

In yet another exemplary embodiment of a powder composite 200 made using first and second powder particles 12, 32 with multilayer first and second coating layers 16, 36, the composite includes dispersed first particles 214 comprising Mg, Al, Zn or Mn, or a combination thereof, as described herein, dispersed second particles 234 comprising carbon nanoparticles and nanomatrix 216 comprise a cellular network of sintered four-layer first and second coating layers 16, 36 comprising first layers 22 that are disposed on the dispersed first and second particles 214; 234 second layers 24 that are disposed on the first layers 22; third layers 26 that are disposed on the second layers 24 and fourth layers 28 that are disposed on the third layers 26. First layers 22 include Al or Ni, or a combination thereof second layers 24 include Al, Zn, Mn, Mg, Mo, W, Cu, Fe, Si, Ca, Co, Ta, Re or Ni, or an oxide, nitride or carbide thereof, or a combination of any of the aforementioned second layer materials; third layers include Al, Zn, Mn, Mg, Mo, W, Cu, Fe, Si, Ca, Co, Ta, Re or Ni, or an oxide, nitride or carbide thereof, or a combination of any of the aforementioned third layer materials; and fourth layers include Al, Mn, Fe, Co or Ni, or a combination thereof. The selection of materials is analogous to the selection considerations described herein for powder composites 200 made using two-layer coating layer powders, but must also be extended to include the material used for the third and fourth coating layers.

In another exemplary embodiment of a powder composite 200, dispersed first particles 214 comprise a metal having a standard oxidation potential less than Zn or a non-metallic material, or a combination thereof, as described herein, dispersed second particles 234 comprising carbon nanoparticles and nanomatrix 216 comprises a cellular network of sintered metallic coating layers 16. Suitable non-metallic materials include various ceramics, glasses or forms of carbon, or a combination thereof. Further, in powder composites 200 that include dispersed first and second particles 214, 234 comprising these metals or non-metallic materials, nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials as nanomatrix material 220.

Figure 13:
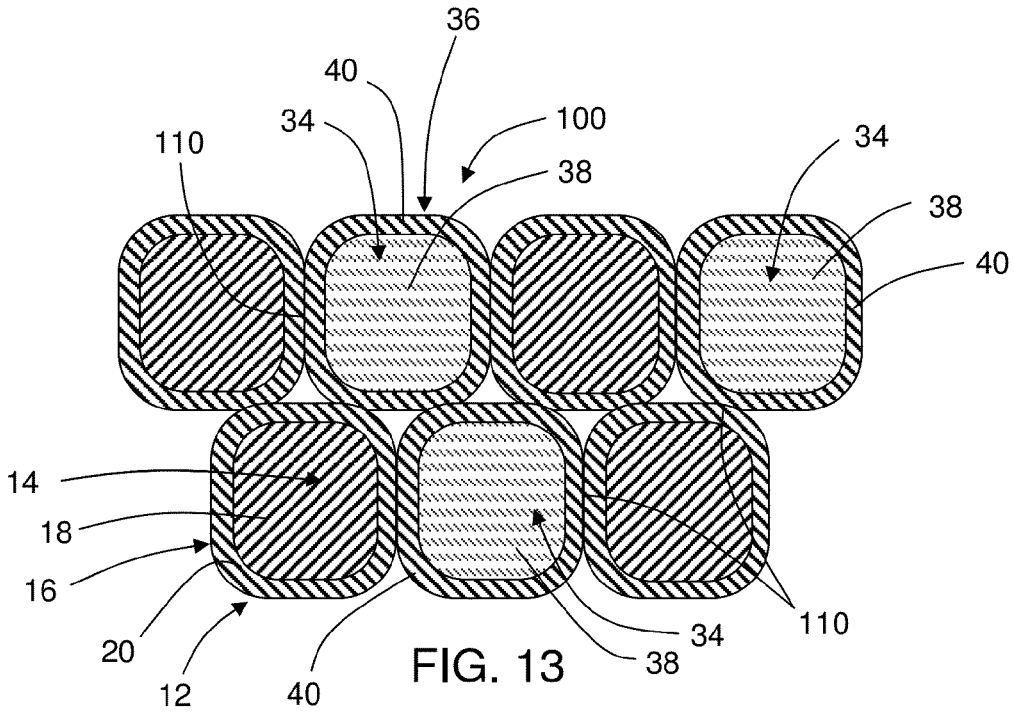
FIG. 13 is a schematic cross-sectional illustration of an exemplary embodiment of a precursor powder composite.

Referring to FIG. 13, sintered powder composite 200 may comprise a sintered precursor powder composite 100 that includes a plurality of deformed, mechanically bonded first and second powder particles 12, 32 as described herein. Precursor powder composite 100 may be formed by composition of first and second powders 10, 30 to the point that first and second powder particles 12, 32 are pressed into one another, thereby deforming them and forming interparticle mechanical or other bonds 110 associated with this deformation sufficient to cause the deformed powder particles 12 to adhere to one another and form a green-state powder composite having a green density that is less than the theoretical density of a fully-dense composite of first powder 10, due in part to interparticle spaces 15. Compaction may be performed, for example, by isostatically pressing first and second powders 10, 30 at room temperature to provide the deformation and interparticle bonding of first and second powder particles 12, 32 necessary to form precursor powder composite 100.

Figure 14:
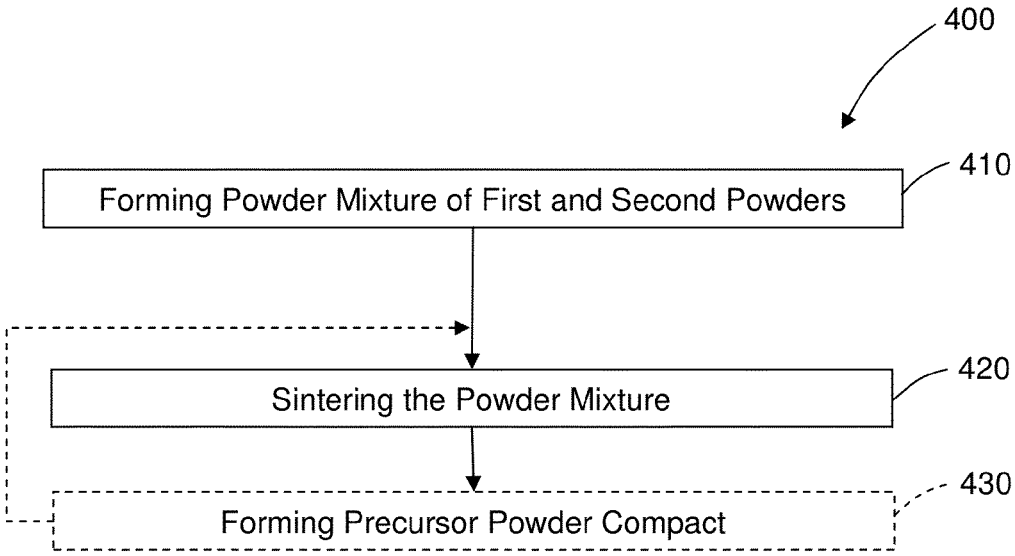
FIG. 14 is a flowchart of an exemplary method of making a powder composite as disclosed herein.

Referring to FIG. 14, a method 400 of making a powder composite 200 is disclosed. Method 400 includes forming 410 a powder mixture 5 comprising first and second coated metallic powders 10, 30 comprising first and second powder particles 12, 32 as described herein. Method 400 also includes forming 420 a powder composite 200 by applying a predetermined temperature and a predetermined pressure to the coated first and second powder particles 12, 32 sufficient to sinter them by solid-phase sintering of the first and second coating layers 16, 36 to form a substantially-continuous, cellular nanomatrix 216 of a nanomatrix material 220 and a plurality of dispersed first and second particles 214, 234 dispersed within nanomatrix 216 as described herein. In the case of powder mixtures 5 that include uncoated second powder particles 32, the sintering comprises sintering of the first coating layers only.

Forming 410 of the powder mixture 5 may be performed by any suitable method. In an exemplary embodiment, forming 410 includes applying the metallic first and second coating layers 16, 36 as described herein, to the first and second particle cores 14, 34 as described herein, using fluidized bed chemical vapor deposition (FBCVD) as described herein. Applying the metallic coating layers may include applying single-layer metallic coating layers or multilayer metallic coating layers as described herein. Applying the metallic coating layers may also include controlling the thickness of the individual layers as they are being applied, as well as controlling the overall thickness of metallic coating layers. Particle cores may be formed as described herein.

Forming 420 of the powder composite 200 may include any suitable method of forming a fully-dense composite of powder mixture 5. In an exemplary embodiment, forming 420 includes dynamic forging of a green-density precursor powder composite 100 to apply a predetermined temperature and a predetermined pressure sufficient to sinter and deform the powder particles and form a fully-dense nanomatrix 216 and dispersed first and second particles 214, 234 as described herein. Dynamic forging as used herein means dynamic application of a load at temperature and for a time sufficient to promote sintering of the metallic coating layers of adjacent first and second powder particles 12, 32 and may preferably include application of a dynamic forging load at a predetermined loading rate for a time and at a temperature sufficient to form a sintered and fully-dense powder composite 200. In an exemplary embodiment, dynamic forging may include: 1) heating a precursor or green-state powder composite 100 to a predetermined solid phase sintering temperature, such as, for example, a temperature sufficient to promote interdiffusion between metallic coating layers of adjacent first and second powder particles 12, 32; 2) holding the precursor powder composite 100 at the sintering temperature for a predetermined hold time, such as, for example, a time sufficient to ensure substantial uniformity of the sintering temperature throughout the precursor composite 100; 3) forging the precursor powder composite 100 to full density, such as, for example, by applying a predetermined forging pressure according to a predetermined pressure schedule or ramp rate sufficient to rapidly achieve full density while holding the composite at the predetermined sintering temperature; and 4) cooling the powder composite 200 to room temperature. The predetermined pressure and predetermined temperature applied during forming 420 will include a sintering temperature, $T_S$, and forging pressure, $P_F$, as described herein that will ensure solid-state sintering and deformation of the powder particles 12 to form fully-dense powder composite 200, including solid-state bond 217 and bond layer 219. The steps of heating to and holding the precursor powder composite 100 at the predetermined sintering temperature for the predetermined time may include any suitable combination of temperature and time, and will depend, for example, on the powder 10 selected, including the materials used for first and second particle cores 14, 34 and first and second metallic coating layers 16, 36 the size of the precursor powder composite 100, the heating method used and other factors that influence the time needed to achieve the desired temperature and temperature uniformity within precursor powder composite 100. In the step of forging, the predetermined pressure may include any suitable pressure and pressure application schedule or pressure ramp rate sufficient to achieve a fully-dense powder composite 200, and will depend, for example, on the material properties of the first and second powder particles 12, 32 selected, including temperature dependent stress/strain characteristics (e.g., stress/strain rate characteristics), interdiffusion and metallurgical thermodynamic and phase equilibria characteristics, dislocation dynamics and other material properties. For example, the maximum forging pressure of dynamic forging and the forging schedule (i.e., the pressure ramp rates that correspond to strain rates employed) may be used to tailor the mechanical strength and toughness of the powder composite. The maximum forging pressure and forging ramp rate (i.e., strain rate) is the pressure just below the composite cracking pressure, i.e., where dynamic recovery processes are unable to relieve strain energy in the composite microstructure without the formation of a crack in the composite. For example, for applications that require a powder composite that has relatively higher strength and lower toughness, relatively higher forging pressures and ramp rates may be used. If relatively higher toughness of the powder composite is needed, relatively lower forging pressures and ramp rates may be used.

For certain exemplary embodiments of powder mixtures 5 described herein and precursor composites 100 of a size sufficient to form many wellbore tools and components, predetermined hold times of about 1 to about 5 hours may be used. The predetermined sintering temperature, $T_S$, will preferably be selected as described herein to avoid melting of either first or second particle cores 14, 34 or first or second metallic coating layers 16, 36 as they are transformed during method 400 to provide dispersed first and second particles 214, 234 and nanomatrix 216. For these embodiments, dynamic forging may include application of a forging pressure, such as by dynamic pressing to a maximum of about 80 ksi at a pressure ramp rate of about 0.5 to about 2 ksi/second.

In an exemplary embodiment where first particle cores 14 include Mg and metallic coating layer 16 includes various single and multilayer coating layers as described herein, such as various single and multilayer coatings comprising Al, the dynamic forging may be performed by sintering at a temperature, $T_S$, of about 450° C. to about 470° C. for up to about 1 hour without the application of a forging pressure, followed by dynamic forging by application of isostatic pressures at ramp rates between about 0.5 to about 2 ksi/second to a maximum pressure, $P_S$, of about 30 ksi to about 60 ksi, which may result in forging cycles of 15 seconds to about 120 seconds. The short duration of the forging cycle is a significant advantage as it limits interdiffusion, including interdiffusion within first and coating layers 16, 36, interdiffusion between adjacent metallic first and second coating layers 16, 36 and interdiffusion between first and second coating layers 16, 36 and respective first and second particle cores 14, 34 to that needed to form metallurgical bond 217 and bond layer 219, while also maintaining the desired microstructure, such as equiaxed dispersed first and second particle 214, 234 shapes, with the integrity of cellular nanomatrix 216 strengthening phase. The duration of the dynamic forging cycle is much shorter than the forming cycles and sintering times required for conventional powder composite forming processes, such as hot isostatic pressing (HIP), pressure assisted sintering or diffusion sintering.

Method 400 may also optionally include forming 430 a precursor powder composite by compaction the plurality of first and second powder particles 12, 32 sufficiently to deform the particles and form interparticle bonds to one another and form the precursor powder composite 100 prior to forming 420 the powder composite. Compaction 430 may include pressing, such as isostatic pressing, of the plurality of powder particles 12 at room temperature to form precursor powder composite 100. In an exemplary embodiment, powder 10 may include first particle cores 14 comprising Mg and forming 430 the precursor powder composite may be performed at room temperature at an isostatic pressure of about 10 ksi to about 60 ksi.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A powder metal composite, comprising:

a substantially-continuous, cellular nanomatrix comprising a nanomatrix material;

a plurality of dispersed first particles each comprising a first particle core material that comprises Mg, Al, Zn or Mn, or a combination thereof, dispersed in the cellular nanomatrix;

a plurality of dispersed second particles intermixed with the dispersed first particles, each comprising a second particle core material that comprises a carbon nanoparticle; and a solid-state bond layer extending throughout the cellular nanomatrix between the dispersed first particles and the dispersed second particles.

2. The powder metal composite of claim 1, wherein the nanomatrix material has a melting temperature ($T_M$), the first particle core material has a melting temperature ($T_{DP1}$) and the second particle core material has a melting temperature ($T_{DP2}$); wherein the composite is sinterable in a solid-state at a sintering temperature ($T_S$), and $T_S$ is less than $T_M$, $T_{DP1}$ and $T_{DP2}$.

3. The powder metal composite of claim 1, wherein the first particle core material comprises Mg—Zn, Mg—Zn, Mg—Al, Mg—Mn, or Mg—Zn—Y.

4. The powder metal composite of claim 1, wherein the first particle core material comprises an Mg—Al—X alloy, wherein X comprises Zn, Mn, Si, Ca or Y, or a combination thereof.

5. The powder metal composite of claim 1, wherein the dispersed first particles further comprise a rare earth element.

6. The powder metal composite of claim 1, wherein the dispersed first particles have an average particle size of about 5 μm to about 300 μm.

7. The powder metal composite of claim 1, wherein the dispersion of dispersed first particles and dispersed second particles comprises a substantially homogeneous dispersion within the cellular nanomatrix.

8. The powder metal composite of claim 1, wherein the carbon nanoparticles comprise functionalized carbon nanoparticles.

9. The powder metal composite of claim 8, wherein the functionalized carbon nanoparticles comprise graphene nanoparticles.

10. The powder metal composite of claim 8, wherein the functionalized carbon nanoparticles comprise fullerene nanoparticles.

11. The powder metal composite of claim 10, wherein the functionalized carbon nanoparticles comprise buckeyballs, buckeyball clusters, buckeypaper, single wall nanotubes or multi-wall nanotubes.

12. The powder metal composite of claim 8, wherein the functionalized carbon nanoparticles comprise nanodiamond particles.

13. The powder metal composite of claim 1, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the first particle core material has a chemical composition that is different than the chemical composition of the nanomatrix material.

14. The powder metal composite of claim 1, wherein the cellular nanomatrix has an average thickness of about 50 nm to about 5000 nm.

15. The powder metal composite of claim 1, wherein the composite is formed from a sintered powder comprising a plurality of first powder particles and second powder particles, each of the first powder particles and the second powder particles having a single layer metallic coating disposed thereon, and wherein the cellular nanomatrix between adjacent ones of the plurality of dispersed first particles and dispersed second particles comprises the single metallic coating layer of one of first or second powder particles, the bond layer and the single metallic coating layer of another of the first or second powder particles.

16. The powder metal composite of claim 15, wherein the dispersed first powder particles comprise Mg and the cellular nanomatrix comprises Al or Ni, or a combination thereof.

17. The powder metal composite of claim 1, wherein the composite is formed from a sintered powder comprising a plurality of first powder particles and second powder particles, each of the first powder particles and the second powder particles having a plurality of metallic coating layers disposed thereon, and wherein the cellular nanomatrix between adjacent ones of the plurality of dispersed first particles and dispersed second particles comprises the plurality of metallic coating layers of one of the first or second powder particles, the bond layer and plurality of metallic coating layers of another of the first or second powder particles, and wherein adjacent ones of the plurality of metallic coating layers each have a different chemical composition.

18. The powder metal composite of claim 17, wherein the plurality of layers comprises a first layer that is disposed on respective ones of the first and second particle cores and a second layer that is disposed on the first layer.

19. The powder metal composite of claim 17, wherein the dispersed first particles comprise Mg and the first layer comprises Al or Ni, or a combination thereof, and the second layer comprises Al, Zn, Mn, Mg, Mo, W, Cu, Fe, Si, Ca, Co, Ta, Re or Ni, or a combination thereof, wherein the first layer has a chemical composition that is different than a chemical composition of the second layer.

20. The powder metal composite of claim 1, wherein the carbon nanoparticles comprise graphene nanoparticles.

21. The powder metal composite of claim 1, wherein the carbon nanoparticles comprise fullerene nanoparticles.

22. The powder metal composite of claim 1, wherein the carbon nanoparticles comprise nanodiamond particles.

23. A powder metal composite, comprising:

a substantially-continuous, cellular nanomatrix comprising a nanomatrix material;

a plurality of dispersed first particles each comprising a first particle core material that comprises Mg, Al, Zn or Mn, or a combination thereof, dispersed in the cellular nanomatrix;

a plurality of dispersed second particles intermixed with the dispersed first particles, each comprising a second particle core material that comprises a metallized carbon nanoparticle; and a solid-state bond layer extending throughout the cellular nanomatrix between the dispersed first particles and the dispersed second particles.

24. The powder metal composite of claim 23, wherein the metallized carbon nanoparticles comprise graphene nanoparticles.

25. The powder metal composite of claim 23, wherein the metallized carbon nanoparticles comprise metallized fullerene nanoparticles.

26. The powder metal composite of claim 25, wherein the metallized fullerene nanoparticles comprise metallized buckeyballs, buckeyball clusters, buckeypaper, single wall nanotubes or multi-wall nanotubes.

27. The powder metal composite of claim 23, wherein the metalized carbon nanoparticles comprise metallized nanodiamond particles.

* * * * *